US006308952B1

(12) United States Patent
Takagi et al.

(10) Patent No.: US 6,308,952 B1
(45) Date of Patent: Oct. 30, 2001

(54) PAPER SHEET DISCHARGE APPARATUS

(75) Inventors: Kazuhiko Takagi; Hiroaki Nishimura; Hiroyuki Kashima; Kazumasa Makino; Atsuo Hirose, all of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/253,551

(22) Filed: Feb. 22, 1999

Related U.S. Application Data

(63) Continuation-in-part of application No. 09/236,466, filed on Jan. 25, 1999.

(30) Foreign Application Priority Data

Jan. 27, 1998 (JP) ..... 10-13686
Feb. 16, 1998 (JP) ..... 10-32471
Feb. 23, 1998 (JP) ..... 10-040213

(51) Int. Cl.[7] ..... B65H 29/60

(52) U.S. Cl. ..... 271/297; 271/298; 271/302; 271/303; 399/110

(58) Field of Search ..... 271/296, 297, 271/302, 303, 298, 287, 289, 290

(56) References Cited

U.S. PATENT DOCUMENTS 5,287,157 * 2/1994 Miyazato et al. ..... 271/297
5,414,503 * 5/1995 Siegel et al. ..... 399/406
5,551,686 9/1996 Sanchez et al. .
5,810,353 * 9/1998 Baskette et al. ..... 271/305

FOREIGN PATENT DOCUMENTS 1-197277 8/1989 (JP) .
9-175714 * 8/1997 (JP) .

* cited by examiner

*Primary Examiner*—Donald P. Walsh
*Assistant Examiner*—Jonathan R Miller
(74) *Attorney, Agent, or Firm*—Oliff & Berridge PLC

(57) ABSTRACT

A paper sheet discharge apparatus comprises a transport roller that transports paper sheets discharged from an image-forming apparatus, a plurality of switching flappers that guide the paper sheets to desired bins, and a plurality of delivery rollers that discharge the paper sheets via the switching flappers to the bins. The paper sheets are reliably stored in the desired bins without decreasing their transport speed by the aid of the transport roller, the switching flappers, and the delivery rollers. The power from a motor is transmitted only to the delivery rollers which are used to discharge the paper sheets while being interlocked with the specified switching flapper.

6 Claims, 18 Drawing Sheets

PAPER SHEET DISCHARGE APPARATUS

This is a Continuation-in-Part of application Ser. No. 09/236,466 filed Jan. 25, 1999. The entire disclosure of the prior application is hereby incorporated by reference herein in its entirety.

BACKGROUND OF THE INVENTION

1. Field of the Invention

The invention relates to a paper sheet discharge apparatus, in particular, to a paper sheet discharge apparatus for receiving, sorting, and accommodating paper sheets, such as print paper sheets discharged from a printing apparatus, such as a printer.

2. Description of the Related Art

Conventional recording medium discharge apparatuses have been used to receive, sort, and accommodate recording media, such as paper sheets discharged from an image-forming apparatus or a printing apparatus, such as copying machines, printers and facsimiles.

Such a recording medium discharge apparatus is disclosed, for example, in Japanese Patent Application Laid-Open No. 1-197277, which includes a plurality of bins for storing paper sheets, and a pair of transport rollers for receiving paper sheets discharged from an image-forming apparatus and discharging them to a predetermined discharge position, wherein the plurality of bins are vertically moved upwardly and downwardly to the fixed discharge positions of the pair of transport rollers so that the paper sheets are sorted into paper sheets stored in the respective bins.

U.S. Pat. No. 5,551,686 (corresponding to Japanese Patent Application Laid-Open No. 8-259093) describes a system that includes a plurality of fixed bins, moving belts for transporting paper sheets discharged from an image-forming apparatus, in an alignment direction of the plurality of bins, and gates provided corresponding to the respective bins, for changing the direction of transport of the paper sheets by the moving belts so that the paper sheets are guided to the corresponding bins.

However, it has also been recently required that the image formation process be performed at high speed, in accordance with which it is also required to perform, at a high speed, the process of sorting and accommodating the paper sheets discharged from the image-forming apparatus. In the case of the apparatus in which the plurality of bins are vertically moved upwardly and downwardly to the fixed discharge position of the pair of transport rollers, it takes a long time to vertically move the bins, and it is difficult to accelerate the sorting and accommodating process. In the case of the system in which the paper sheets, which are discharged from the image-forming apparatus, are transported by using the moving belts, and the transport direction is changed by using the gate to discharge the paper sheets to the respective bins, the rearward end of the paper sheet may not be able to be discharged reliably to the bin if the resistance between the paper sheet and the bin is large when the paper sheets are fed from the moving belts to the respective bins. Therefore, such a system can become jammed with the paper sheets, for example. Further, in the case of any one of the conventional recording medium discharge apparatuses and systems, the increase in load exerted on a driving source, and the noise generated during operation, cause problems when attempting to attain high speed performance.

Japanese Patent Application Laid-Open No. 9-175714 discloses a paper sheet discharge apparatus that includes multiple stages of delivery units provided in an integral manner to make it possible to distribute paper sheets discharged from a paper sheet-processing unit. The delivery unit includes a tray for accommodating paper sheets, a receiving port for receiving the paper sheets transported from the paper sheet discharge apparatus, a transport means for transporting the paper sheets transported from the receiving port, a discharge port for allowing the paper sheets transported by the transport means to be discharged to the receiving port of the delivery unit, and a guide means for guiding the paper sheets imported from the receiving port to the tray or the discharge port (claim 9 in Japanese Patent Application Laid-Open No. 9-175714). The paper sheet discharge apparatus further includes a driving unit through which the delivery unit is installed to a printer. The driving unit guides the paper sheets exclusively into either the delivery unit or a discharging stacker of the printer.

SUMMARY OF THE INVENTION

It is therefore an object of the invention to provide a paper sheet discharge apparatus which makes it possible to sort and accommodate paper sheets, such as those discharged from a printing apparatus, reliably at a high speed and easily.

According to an aspect of the invention, a recording medium discharge apparatus is provided which is detachably attached to an image forming apparatus, which includes a recording medium receiving device having an installing unit that installs the recording medium receiving device in the image forming apparatus, an introducing unit that introduces a recording medium at a location where an image is formed by the image forming apparatus, and a curl eliminating unit that eliminates curling of the recording medium introduced by the introducing unit, and a recording medium sorting device having a plurality of storing units that store the recording medium introduced by the introducing unit, a discharge unit that discharges the recording medium introduced by the introducing unit into the plurality of storing units, a transport unit that transports the recording medium introduced by the introducing unit to the discharge unit, and a switching unit that switches a transport direction for transporting the recording medium introduced by the introducing unit to the discharge unit, and wherein the recording medium receiving device and the recording medium sorting device are separately formed and detachably connectable to each other.

The paper sheet discharge apparatus according to the invention can be attached with a different type of image forming apparatus by replacing an inappropriate introducing section with an appropriate type of introducing section which complies with the different type of image forming apparatus to which the paper sheet discharge apparatus is to be attached. Namely, it is not necessary to exchange the entire paper sheet discharge apparatus, and instead it is sufficient to only exchange the introducing section when the paper sheet discharge apparatus is attached to the different type of image forming apparatus. Therefore, a user can easily use the paper sheet discharge apparatus. Further, when purchasing a new image forming apparatus to change the type of image forming apparatus, the user only needs to exchange the introducing section, and does not need to exchange the sorting section. Accordingly, in the above-described case, the user can purchase the paper sheet discharge apparatus at a much lower cost than if the user was to purchase the paper sheet discharge apparatus as a whole for replacing. Further, a redesigning of the paper sheet discharge apparatus, including the sorting section, is not necessary for each type of image forming apparatus.

Therefore, time and trouble needed for performing research and development for each type of paper sheet discharge apparatus can be reduced. Also, the cost of manufacturing the paper sheet discharge apparatuses can be reduced due to the increase of common parts for each type of paper sheet discharge apparatus.

Further, since the curl eliminating unit is disposed in the introducing section, curling of the paper sheet can be removed from the paper immediately before sorting and stacking in the sorting section according to the direction that the paper takes to the sorting section. Therefore, the paper sheet, of which any curling has been removed, can be smoothly fed into the sorting section. Accordingly, the paper sheet can be stacked in any orderly manner in each bin, and paper sheet jams can be reduced.

DESCRIPTION OF THE PREFERRED EMBODIMENTS

Figure 1:
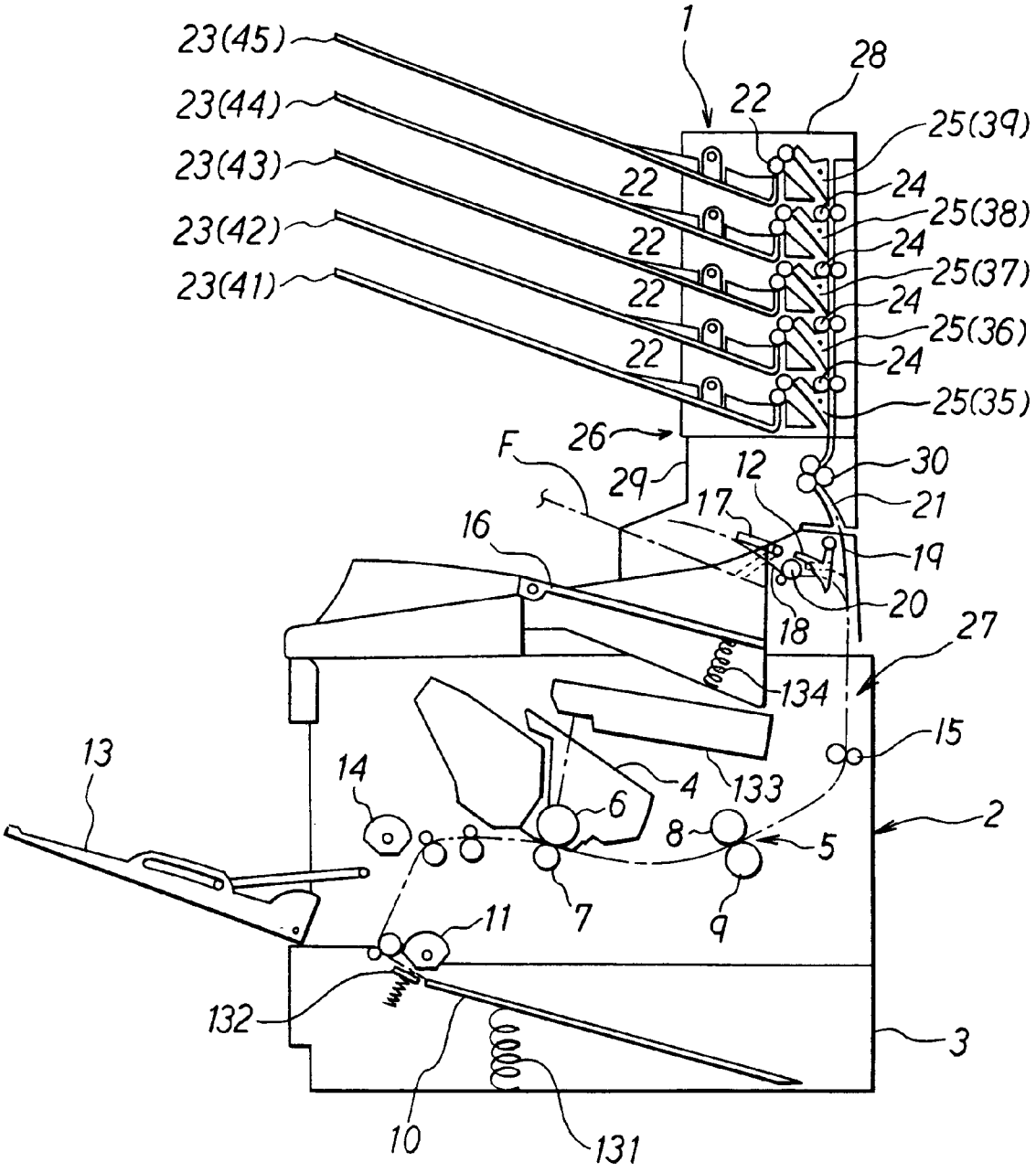
FIG. 1 is a cross-sectional side view of main components illustrating an embodiment of a laser printer as an image-forming apparatus (printing apparatus) provided with a paper sheet discharge apparatus of the invention.

FIG. 1 is a cross-sectional side view of main components illustrating an embodiment of a laser printer 2 as an image-forming apparatus provided with a paper sheet discharge apparatus 1 of the invention.

With reference to FIG. 1, a paper sheet cassette 3 that accommodates paper sheets as recording media in a stacked state is provided under the laser printer 2. The paper sheet cassette 3 is provided with a receiving plate that receives the paper sheets in the stacked manner and a spring 131 that urges a receiving plate 10 upwardly. A transport roller 11 and a friction separator pad 132, which are used to separate and feed, one by one, the paper sheets stacked on the receiving plate 10, are provided in the vicinity of one end of the receiving plate 10. The paper sheets, which are stacked in the cassette 3, are transported toward an image-forming unit 4 as described below.

The image-forming unit 4 is arranged downstream of the paper sheet cassette 3 in the transport direction of the paper sheet. The image-forming unit 4 is provided in order that an electrostatic latent image, which is formed by exposing a photosensitive member-equipped drum after charging, with the light in accordance with image information by using a laser scanner 133, is developed with toner to form a toner image. A fixing unit 5 that fixes the toner transferred to the paper sheet is arranged downstream of the image-forming unit 4. The image-forming unit 4 comprises the photosensitive member-equipped drum 6, a developing unit (not shown), a charging unit (not shown), and other components. After charging the photosensitive member-equipped drum 6, the electrostatic latent image, which is formed by exposure and scanning with the laser scanner 133, is developed with the toner to form the toner image. A transfer roller 7 that transfers the toner image formed on the photosensitive member-equipped drum 6 onto the paper sheet is provided under the photosensitive member-equipped drum 6.

On the other hand, the fixing unit 5 comprises a heating roller 8 and a pressing roller 9 which is arranged in opposition to the heating roller 8. The paper sheet, which is transported from the cassette 3, is fed to the space between the photosensitive member-equipped drum 6 and the transfer roller 7 of the image-forming unit 4 to transfer the toner image thereon. After that, the paper sheet is fed to the space between the heating roller 8 and the pressing roller 9 of the fixing unit 5 to fix the transferred toner image. The paper sheet is then fed to the discharge rollers 15 described below.

A discharge unit 27 that discharges the paper sheets is provided downstream of the fixing unit 5 in the paper sheet transport direction. The discharge unit 27 comprises discharge rollers 15 that discharge the paper sheets, a discharge tray-side guide passage 18 that discharges the paper sheets discharged from the discharge rollers 15 toward a discharge tray 16 described below, and an introducing passage-side guide passage 19 that discharges the paper sheets toward an introducing section of the paper sheet discharge apparatus 1 described below.

The discharge tray 16, which serves as a receiving section for receiving the paper sheets discharged by the discharge rollers 15 and stacking the paper sheets in a stacked manner, is provided on the downstream side of the discharge tray-side guide passage 18. The discharge tray 16 is provided in a recess formed at an upper portion of the laser printer 2. A downstream end of the discharge tray 16 is rotatably supported, and an upstream end thereof is urged upwardly by a spring 134. When the paper sheets are stacked, the discharge tray 16 is gradually rotated downwardly as its weight is increased. Accordingly, it is possible to stack a large amount of paper sheets in an aligned state. A discharge tray level sensor 17, which serves as a received amount-detector that detects the fact that the capacity of the discharge tray 16 is filled with the stacked paper sheets, i.e., the full level, is attached to a downstream upper portion of the discharge tray 16. The discharge tray level sensor 17 has a detecting tab which is rotatably movable. The discharge tray level sensor 17 detects the full level if the paper sheets are stacked up to a position indicated by a phantom line F. Specifically, the detecting tab abuts against the upper surface of the paper sheet, and the detecting tab ceases to make rotation downwardly beyond the position indicated by the phantom line.

An uncurling roller 20 that removes curling of the paper sheet is provided in the discharge tray-side guide passage 18. The laser printer 2 is provided with a manual feed tray 13 and a transport roller 14 that transports the paper sheet placed on the manual feed tray 13.

Figure 2:
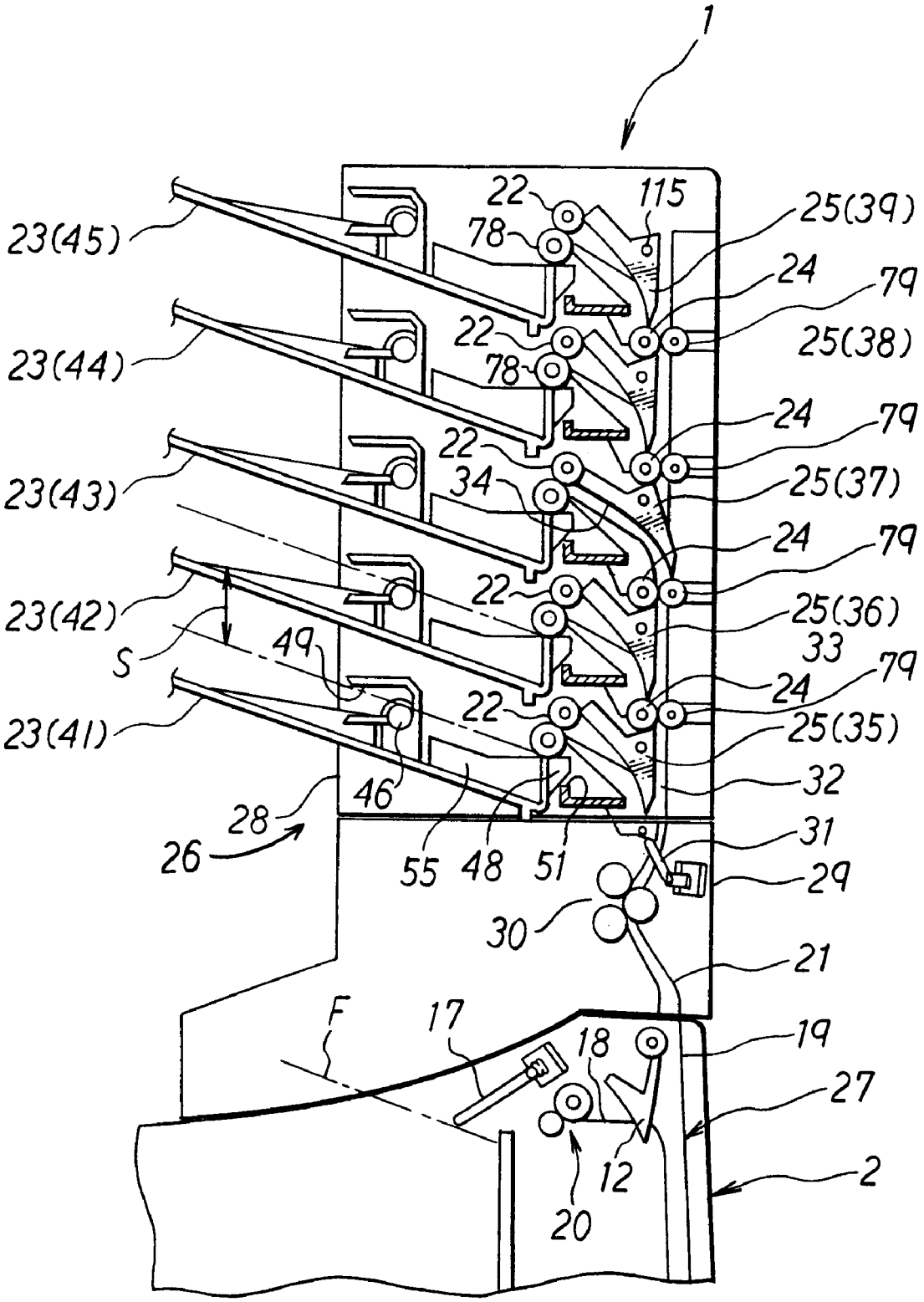
FIG. 2 is a magnified cross-sectional view of main components illustrating the paper sheet discharge apparatus of FIG. 1.

The paper sheet discharge apparatus 1 is detachably attached to the upper portion of the laser printer 2 constructed as described above. FIG. 2 is a magnified cross-sectional view of main components illustrating the paper sheet discharge apparatus 1 of FIG. 1.

Next, the paper sheet discharge apparatus 1 will be explained with reference to FIG. 2. As shown in FIG. 2, the paper sheet discharge apparatus 1 comprises, in its casing 26, an introducing passage 21 as the introducing section for receiving the paper sheet on which a predetermined image is formed by the image-forming apparatus 2, a plurality of delivery rollers 22 that discharge the paper sheet, a plurality of bins 23 as storing units provided corresponding to the respective delivery rollers 22, that store the paper sheets discharged from the respective delivery rollers 22, transport rollers 24 that transport the paper sheet received from the introducing passage 21 to the respective delivery rollers 22, and a plurality of switching flappers 25 that switch the transport direction in order to transport the paper sheet received from the introducing passage 21 to the specified delivery rollers 22.

The casing 26 is formed such that it is dividable into an upper casing 28 which is provided with the discharge rollers 22, the plurality of bins 23, the transport rollers 24, the switching flappers 25, and other components, and a lower casing 29 which is provided with the introducing passage 21. The lower casing 29 is detachably attached to the upper portion of the laser printer 2, and the introducing passage 21 is connected to the introducing passage-side guide passage 19 of the discharge unit 27.

The lower casing 29 is formed with the introducing passage 21 which penetrates through the lower casing 29 in the vertical direction for feeding the paper sheets discharged by the discharge roller 15 of the laser printer 2 toward the upper casing 28. The lower casing 29 is provided with an uncurling roller 30 that uncurls the paper sheet at an intermediate position of the introducing passage 21, and a count lever 31 that detects the passage of the paper sheet at a downstream position from the uncurling roller 30. The curling of the paper sheet occurs after the paper sheet is fed through the fixing unit 5, mainly due to heat and pressure generated by the heating roller 8 and the pressing roller 9 of the fixing unit 5.

The lower casing 29 further comprises a selector flapper 12 as a selective discharge device which protrudes downwardly from the lower casing 29 and which is inserted into the discharge unit 27 of the laser printer 2 when the lower casing 29 is attached to the upper portion of the laser printer 2. The selector flapper 12 switches the discharge direction to determine whether the paper sheet fed by the discharge roller 15 is discharged toward the discharge tray 16 or the paper sheet is discharged toward the introducing passage 21. The selector flapper 12 is provided to be swingable between a discharge tray-side guide position (position indicated by phantom lines in FIG. 1) to guide the paper sheet toward the discharge tray 16 and an introducing passage-side guide position (position indicated by solid lines in FIG. 1) to guide the paper sheet toward the introducing passage 21. The paper sheet, which is fed by the discharge roller 15, is selectively fed to the discharge tray-side guide passage 18 or the introducing passage-side guide passage 19 in accordance with the swinging action of the selector flapper 12. The selector flapper 12 is operated by a selector flapper-operating solenoid 77 as described below (see FIG. 10). When the selector flapper 12 as described above is provided on the side of the paper sheet discharge apparatus 1, it is possible to simplify the structure of the laser printer 2, because all of the members for determining the discharge direction of the paper sheet can be arranged on the side of the paper sheet discharge apparatus 1. Therefore, each element that is necessary only when the paper sheet discharge apparatus 1 is installed on the laser printer 2, does not need to be provided in the laser printer 2. Accordingly, the cost of manufacturing the laser printer 2 is prevented from increasing.

Alternatively, the selector flapper 12 may be provided on the side of the laser printer 2, instead of on the side of the paper sheet discharge apparatus 1. In this arrangement, it is possible to simplify the structure on the side of the paper sheet discharge apparatus 1.

The upper casing 28 has a box-shaped configuration with its one open side. A plurality of bins 23 that store the paper sheets are arranged in a vertically aligned state on the open side. The plurality of bins 23 are successively aligned in an order of the fist bin 41, the second bin 42, the third bin 43, the fourth bin 44, and the fifth bin 45, from the lowermost position to the uppermost position.

The delivery rollers 22 are respectively provided at rearward ends of the respective bins 23. The respective delivery rollers 22 are provided as pairs. One of the pair of delivery rollers 22 is driven, and the other of the pair follows it. A transport passage 32 is formed in the upper casing 28. One end of the transport passage 32 is connected to the introducing passage 21 of the lower casing 29, and the other end thereof faces the respective delivery rollers 22. The transport passage 32 includes a vertically directed transport passage 33 formed in the vertical direction through the upper casing 28, and a plurality of delivery transport passages 34 branched from the vertically directed transport passage 33 toward the respective delivery rollers 22. The transport passage 32 makes it possible to guide the paper sheets received by the introducing passage 21 to the respective delivery rollers 22.

Switching flappers 25 corresponding to the respective delivery rollers 22 are provided respectively at positions at which the vertically directed transport passage 33 is branched to the respective delivery transport passages 34 (in the following description, when it is intended to distinguish the switching flappers 25 corresponding to the first to fifth bins 41 to 45 respectively from each other, they are referred to as first to fifth flappers 35 to 39 respectively). The switching flapper 25 is swingably supported by a support point of a flapper shaft 115 formed integrally with the switching flapper 25 between a vertically directed guide position (position indicated by the switching flappers 25 other than the third switching flapper 37 in FIG. 2) that guides the paper sheet in the vertical direction and a delivery-directed guide position (position indicated by the third switching flapper 37 in FIG. 2) that guides the paper sheet to the corresponding delivery rollers 22. The paper sheet, which has been introduced into the upper casing 28, is guided through the vertically directed transport passage 33 to the arbitrary delivery transport passage 34 in accordance with the swinging action of the switching flapper 25.

The transport rollers 24 that transport the paper sheets in the vertical direction are provided between the respective switching flappers 25 in the vertically directed transport passage 33. The respective transport rollers 24 are provided as pairs. One of the pair of transport rollers 24 is driven, and the other of the pair follows it.

The paper sheets, which are discharged from the laser printer 2, are stored in the respective bins 23 as follows in the paper sheet discharge apparatus 1 constructed as described above.

That is, when the selector flapper 12 is switched to be at the introducing passage-side guide position (position indicated by the solid lines in FIG. 1) in the discharge unit 27 of the laser printer 2, the paper sheet, on which the predetermined image is formed, is received from the discharge roller 15 through the selector flapper 12 to the introducing passage 21 formed in the lower casing 29 of the paper sheet discharge apparatus 1. The curling of the paper sheet received by the introducing passage 21 is removed by the uncurling roller 30. After that, the paper sheet pushes and moves the count lever 31, and it is introduced into the transport passage 32 on the side of the upper casing 28. When the count lever 31 is pushed and moved, the detection signal is then outputted, and the presence or absence of a paper sheet advanced into the paper sheet discharge apparatus 1 is judged by CPU 40, as described below.

Therefore, when a paper sheet jam has occurred, it is easily determined whether the paper sheet jam has occurred in an area of the laser printer 2 or in an area of the upper casing 28 of the paper sheet discharge apparatus 1.

Since the uncurling roller 30 is disposed in the lower casing 29 and an introducing passage 221 is extended approximately straight from downstream of the uncurling roller 30 to the upper casing 28, curling of the paper sheet can be removed immediately before sorting and stacking in the upper casing 28, and removed according to the direction of paper sheet travel to the upper casing 28. Therefore, the paper sheet, of which curling has been removed, can be smoothly and almost straight fed into the upper casing 28 without winding feed. Accordingly, the paper sheet can be stacked in an orderly manner in each bin 23, and the occurrence of paper sheet jams can be reduced.

Further, not only the laser printer 2, as in the present embodiment, but also printers such as copy machines and ink jetting printers, may also discharge printed paper sheets that are curled if they include fixing units using heat. Therefore, the curling eliminating unit (i.e., uncurling roller 30 in this embodiment) of the invention should be effective for these copy machines and ink jet printers.

The paper sheet, which has been introduced into the transport passage 32, is transported through the vertically directed transport passage 33 in accordance with the rotational driving of the transport rollers 24. When the paper sheet arrives at the switching flapper 25 located at the delivery-directed guide position, the paper sheet is then guided by the switching flapper 25, and it is guided to the delivery rollers 22 corresponding to the switching flapper 25. This process will be described in further detail below.

The first to fifth flappers 35 to 39 are controlled by CPU 40 described below. (See FIG. 10). Accordingly, only the specified switching flapper 25, which is directed to the delivery rollers 22 corresponding to the bin 23 in which it is intended to store the paper sheet, is located at the delivery-directed guide position. The other switching flappers 25 are located at the vertically directed guide position. The switching flapper is switched by operating a switching flapper-operating solenoid 64 shown in FIGS. 3 and 10 as described below.

FIG. 2 shows the storage of paper sheets in the third bin 43, in which the first, second, fourth, and fifth flappers 35, 36, 38, 39, i.e., the flappers other than the third flapper 37 are located at the vertically directed guide position, while only the third flapper 37 is located at the delivery-directed guide position. In the illustrative case shown in FIG. 2, when the paper sheet is introduced into the transport passage 21, the paper sheet is fed upwardly through the vertically directed transport passage 33 by the aid of the transport rollers 24, because the first and second switching flappers 35, 36 are located at the vertically directed guide position. When the paper sheet arrives at the third flapper 37 located at the delivery-directed guide position, then the transport direction is switched into the direction directed to the delivery transport passage 34, and the paper sheet is fed to the delivery rollers 22 corresponding to the third bin 43. The paper sheet is discharged by the delivery rollers 22, and it is stored in the third bin 43. All of the delivery rollers 22 and the transport rollers 24 are driven by a motor 65 shown in FIG. 3 by the aid of driving shafts 80 and a gear array (not shown).

According to the structure as described above, the paper sheet, which is received from the introducing passage 21, is transported through the vertically directed transport passage 33 by the aid of the transport rollers 24 without decreasing its speed until the paper sheet arrives at the specified switching flapper 25. After the transport direction is switched by the specified switching flapper 25, the paper sheet is discharged by the delivery rollers 22 without decreasing its speed toward the bin 23 corresponding to the delivery rollers 22 until the frontward end and the rearward end of the paper sheet are completely discharged. Therefore, the paper sheet, on which the image is formed by the laser printer 2, is sorted and accommodated reliably at a high speed.

In the paper sheet discharge apparatus 1, the plurality of bins 23 are detachably attached to the upper casing 28.

Figure 3:
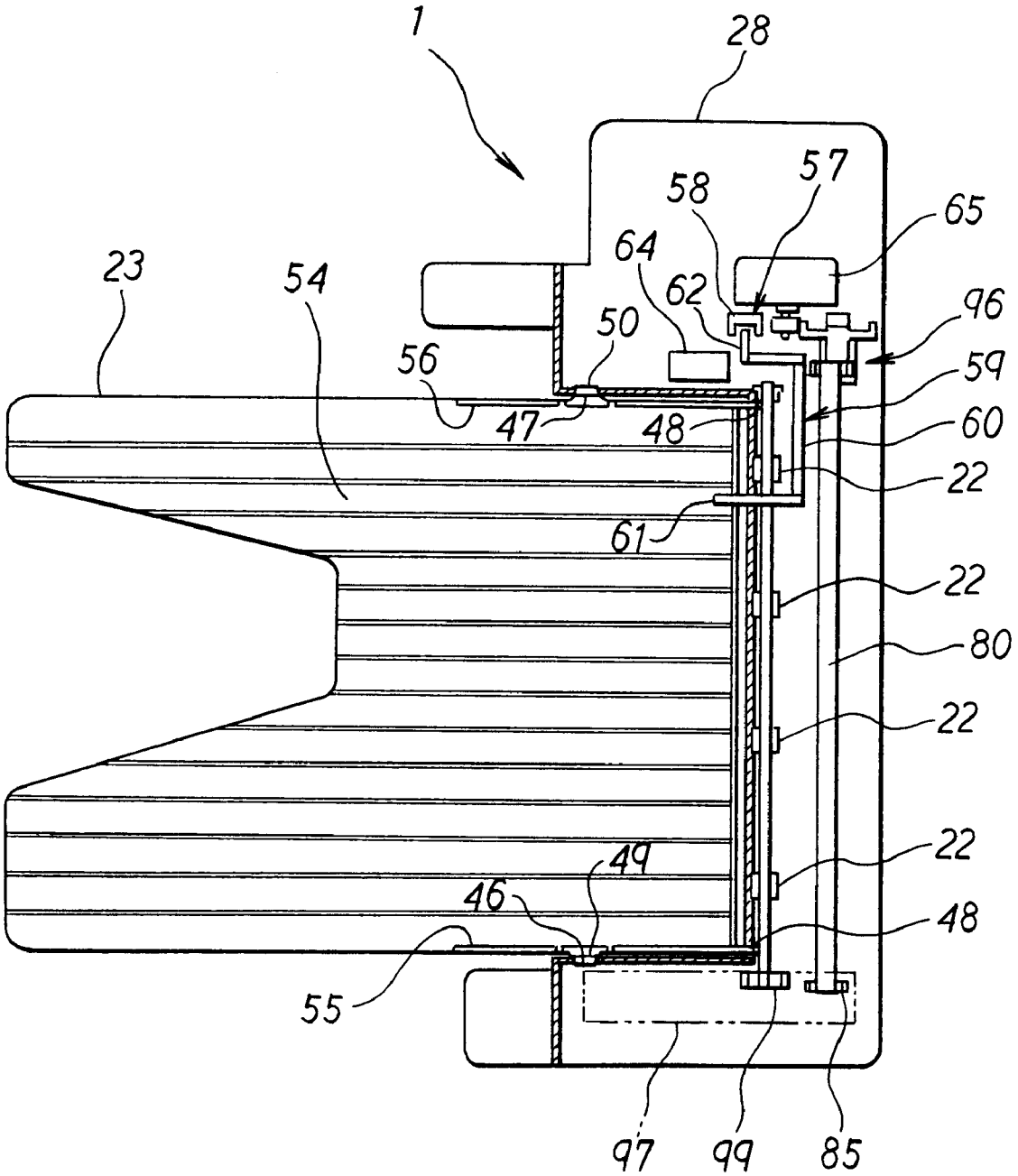
FIG. 3 is a cross-sectional top view of main components in which a bin is viewed from an upper position.
Figure 4:
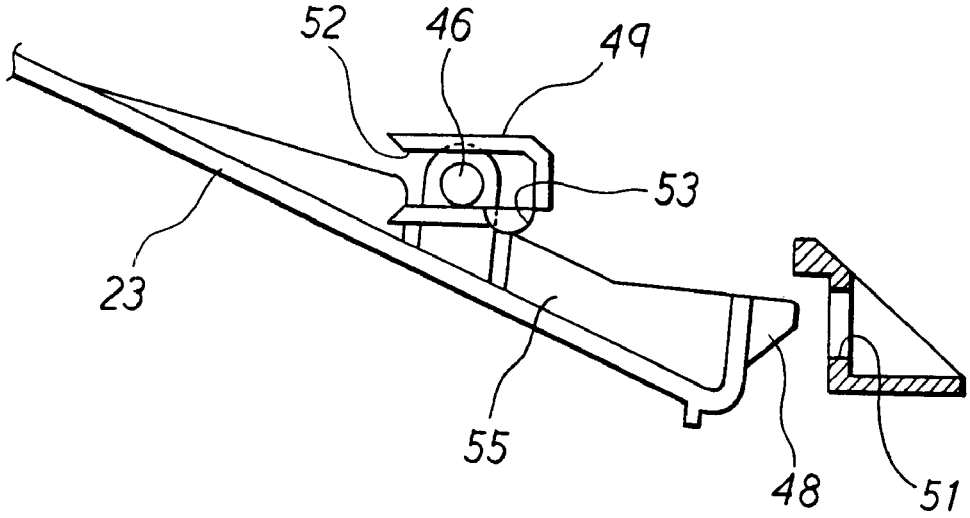
FIG. 4 is a cross-sectional view showing an attachment/detachment state of the bin of FIG. 2.
Figure 5:
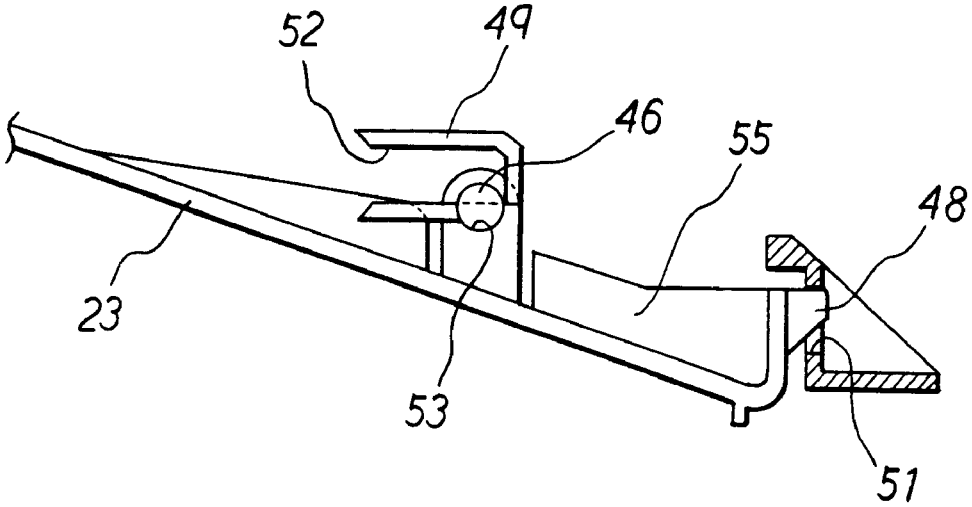
FIG. 5 is a cross-sectional view showing an attachment/detachment state of the bin of FIG. 2.
Figure 6:
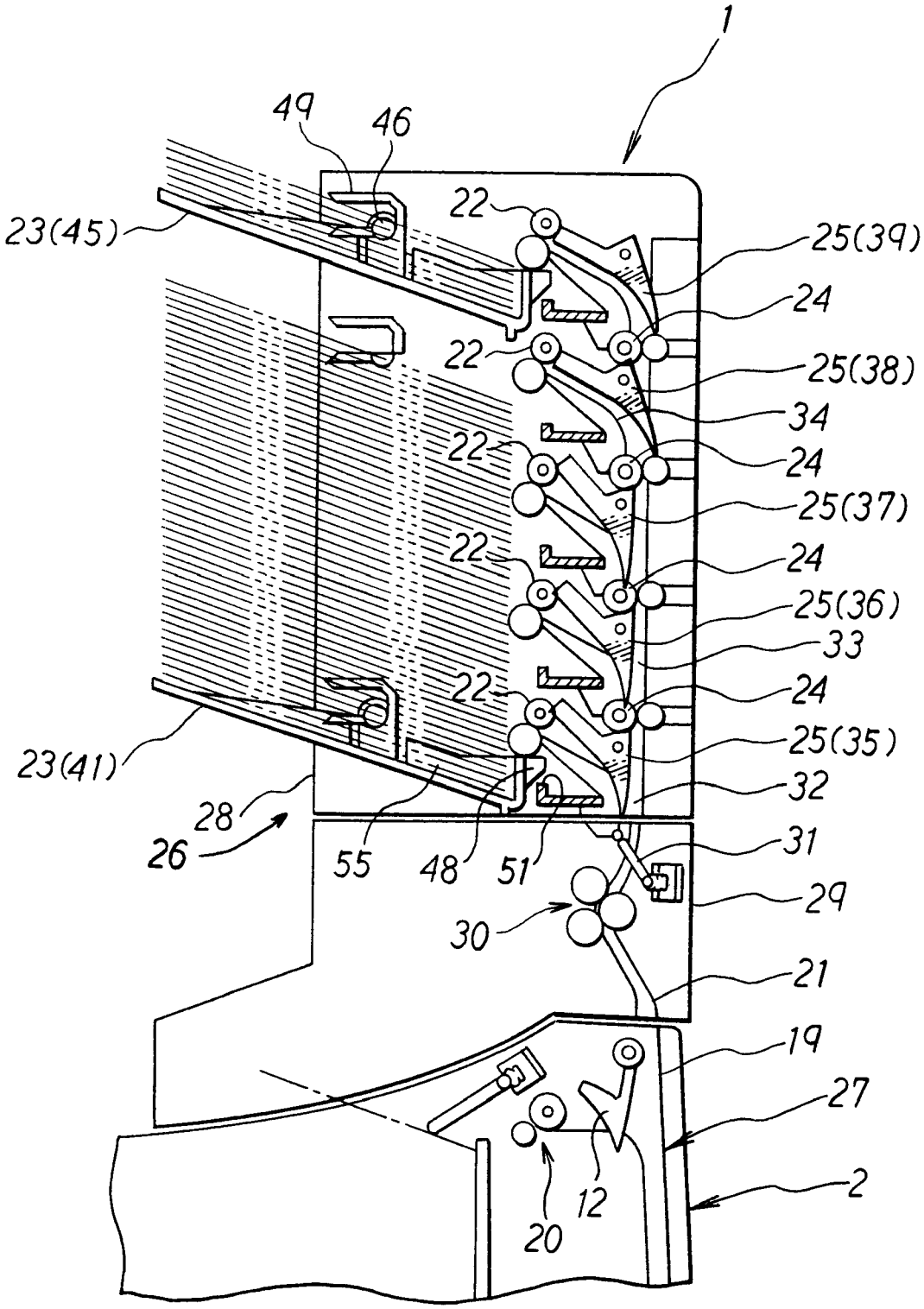
FIG. 6 is a cross-sectional view of main components corresponding to the paper sheet discharge apparatus of FIG. 2, illustrating a state in which the second to fourth bins are removed.

FIG. 3 shows a cross-sectional top view of main components in which one of the bins 23 is viewed from an upper position. FIGS. 4 and 5 illustrate attachment/detachment states of the bin 23. FIG. 6 shows a cross-sectional view of main components corresponding to FIG. 2, illustrating a state in which the second to fourth bins 42 to 44 are removed. The attachment and the detachment of the bin 23 will be explained with reference to FIGS. 3 to 6.

Each of the bins 23 is provided with a receiving tray section 54 that receives the paper sheets as shown in FIG. 3, and guide sections 55, 56 which extend upwardly perpendicularly from both widthwise ends of the receiving tray section 54, as shown in FIGS. 4 and 5, respectively. Both guide sections 55, 56 are formed with columnar side projections 46, 47 which protrude in the widthwise direction, respectively. Rear projections 48 are formed at their rearward ends to protrude in the rearward direction. On the other hand, as shown in FIG. 3, side receiving grooves 49, 50, which are opposed to the side projections 46, 47, are formed on the upper casing 28. As shown in FIGS. 4 and 5, rear receiving holes 51, which are opposed to the rear projections 48, are formed on the upper casing 28. Each of the side receiving grooves 49, 50 has a long groove section 52 which extends in the longitudinal direction, and an arc-shaped fastening section 53, which is disposed at a rearward lower portion of the long groove section 52 and which fixes the side projection 46, 47.

When the bin 23 is installed to the upper casing 28, the side projections 46, 47 are inserted through openings of the long groove sections 52 as shown in FIG. 4. The side projections 46, 47 are allowed to fall into the fastening sections 53, as shown in FIG. 5, simultaneously with which the rear projections 48 are inserted into the rear receiving holes 51. By doing so, the bin 23 is rotated counterclockwise as shown in FIG. 5 by its own weight about the center of the projections 46, 47, and upper portions of the rear projections 48 are fastened to upper portions of the rear receiving holes 51. Thus, the bin 23 is fixed. When the bin 23 is removed, a process reverse to the above operation may be performed. That is, the side projections 46, 47 are successfully drawn through the openings of the long groove sections 52. When the respective bins 23 are detachably attached as described above, the following advantage is obtained. That is, for example, the respective bins 23 are installed during ordinary use, and they can be used for the sorting process (state shown in FIG. 2). Further, when it is intended to stack a large number of paper sheets, an arbitrary bin 23, or arbitrary bins 23, may be removed. Thus, the space, which is formed by removing the bin or bins 23 (as indicated by S in FIG. 2), can be used as a space for storing the paper sheets, making it possible to use the space as a stacker for storing a larger amount of paper sheets.

FIG. 6 shows an embodiment using a stacker as described above. In FIG. 6, only the first bin 41 and the fifth bin 45 are installed, and the second to fourth bins 42 to 44 are removed. FIG. 6 shows a state in which a larger amount of paper sheets are stacked on the first bin 41 to such an extent that the second to fourth bins 42 to 44 are eliminated.

Figure 7:
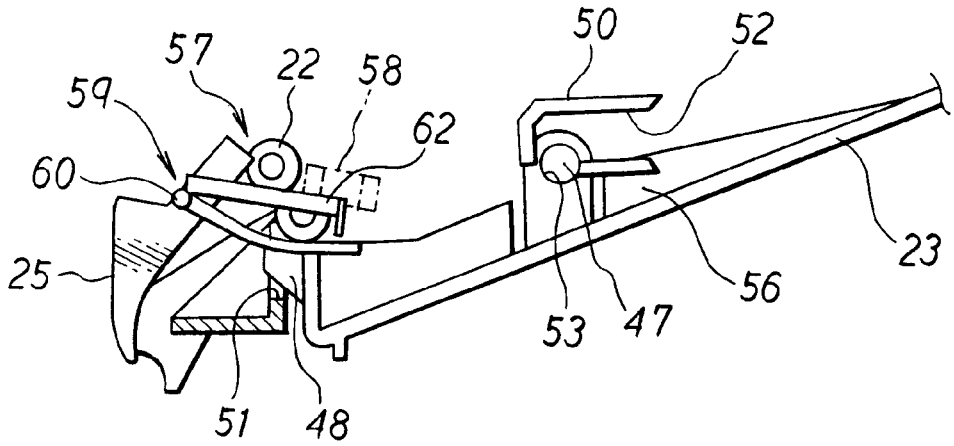
FIG. 7 is a cross-sectional view showing an operation state of a bin level sensor.
Figure 8:
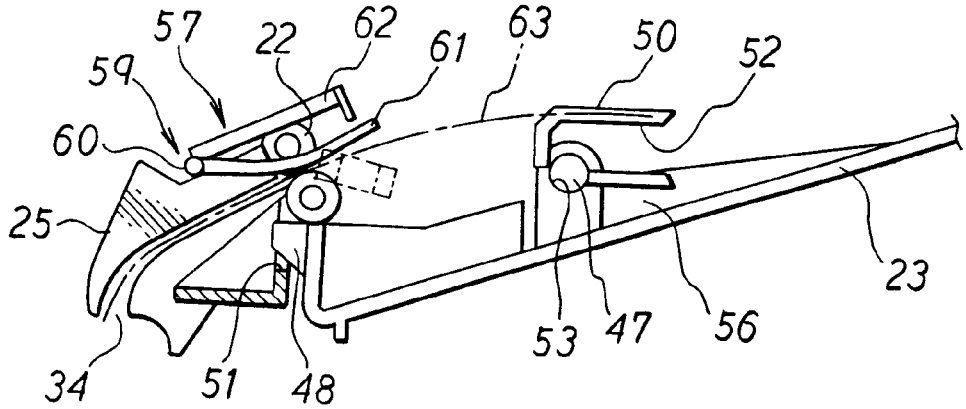
FIG. 8 is a cross-sectional view showing an operation state of the bin level sensor.
Figure 9:
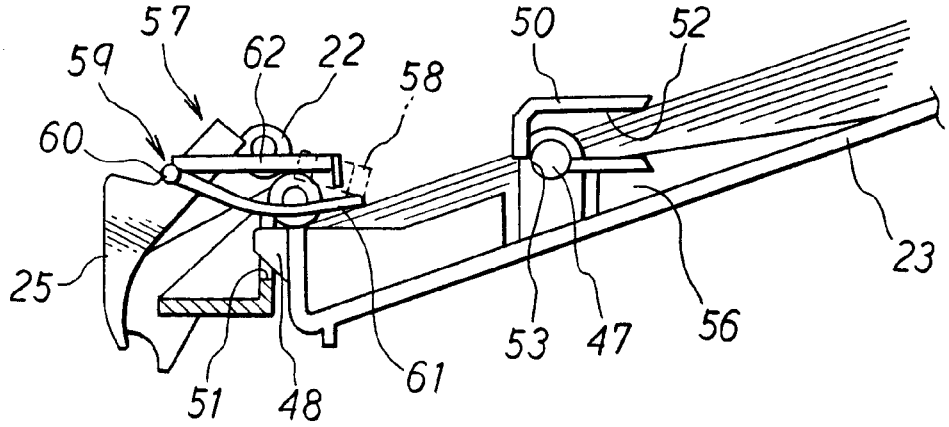
FIG. 9 is a cross-sectional view showing an operation state of the bin level sensor.

Each of the bins 23 is provided with a bin level sensor 57 that detects the fact that each of the bins 23 is filled with stored paper sheets, i.e., the fall level. FIGS. 7 to 9 illustrate operation states of the bin level sensor 57. The operation of the bin level sensor 57 will be explained with reference to FIG. 3 and FIGS. 7 to 9.

With reference to FIG. 3, the bin level sensor 57 comprises an optical sensor 58 formed to have a ]-shaped (angular U-shaped) cross section and having, at the inside of the ]-shaped configuration, a light-emitting section and a light-receiving section, and a swingable lever 59 that allows the light for the optical sensor 58 to pass through or to be shut off depending on the amount of stacked paper sheets. The swingable lever 59 comprises a pivot shaft 60 which is rotatably supported at a rearward portion of the bin 23, a paper sheet-abutting lever 61 which extends from one end of the pivot shaft 60 to the receiving tray section 54 of the bin 23, and which abuts against the uppermost paper sheet stored in the receiving tray section 54, and an optical sensor-entering lever 62 which extends from the other end of the pivot shaft 60 to the inside of the ]-shaped configuration of the optical sensor 58, that allows the light directed from the light-emitting section to the light-receiving section to pass through or to be shut off.

When no paper sheet is stored in the bin 23, the paper sheet-abutting lever 61 is in a state of being lowered to the lowermost position by its own weight, as shown in FIG. 7. Corresponding thereto, the optical sensor-entering lever 62 is held at a position under the optical sensor 58. When the paper sheet is discharged by the delivery rollers 22 to the bin 23 as shown in FIG. 8, the paper sheet-abutting lever 61 is flipped by the discharged paper sheet (indicated by a phantom line 63 in FIG. 8), and it is held at a position over the optical sensor 58 corresponding thereto. When the paper sheet is fully discharged, the paper sheet-abutting lever 61 is restored again to the state shown in FIG. 7. The vertical swinging movement of the swingable lever 59 as described above is repeated until the bin 23 is filled with the discharged paper sheets. When the paper sheet-abutting lever 61 is flipped, and when it is restored from the flipped position to the state shown in FIG. 7, the optical sensor-entering lever 62 then instantaneously shuts off the optical sensor 58 corresponding thereto. However, the control is made by CPU, described below, so that the instantaneous period of time is judged such that the optical sensor 58 does not detect the full level. When the bin 23 is filled with the discharged paper sheets, the paper sheet-abutting lever 61 abuts against the uppermost paper sheet of the paper sheets which fill the bin 23, as shown in FIG. 9. Corresponding thereto, the optical sensor-entering lever 62 is held at the inside of the ]-shaped configuration of the optical sensor 58. In this situation, the light, which is radiated from the light-emitting section to the light-receiving section of the optical sensor 58, is continuously shut off by the optical sensor-entering lever 62. This situation provides a detection signal which indicates the fact that the bin 23 is filled with the paper sheets, i.e., the full level signal to be outputted to CPU 40, as described below.

The paper sheet discharge apparatus 1 according to the embodiment of the invention, which is provided with the bin level sensors 57 for the respective bins 23, is controlled as follows. That is, if the bin level sensor 57 detects the fact that the specified bin 23 is filled with the discharged paper sheets, the switching flapper 25 is switched so that the paper sheets are transported to another bin 23 for which the fill level is not detected.

Figure 10:
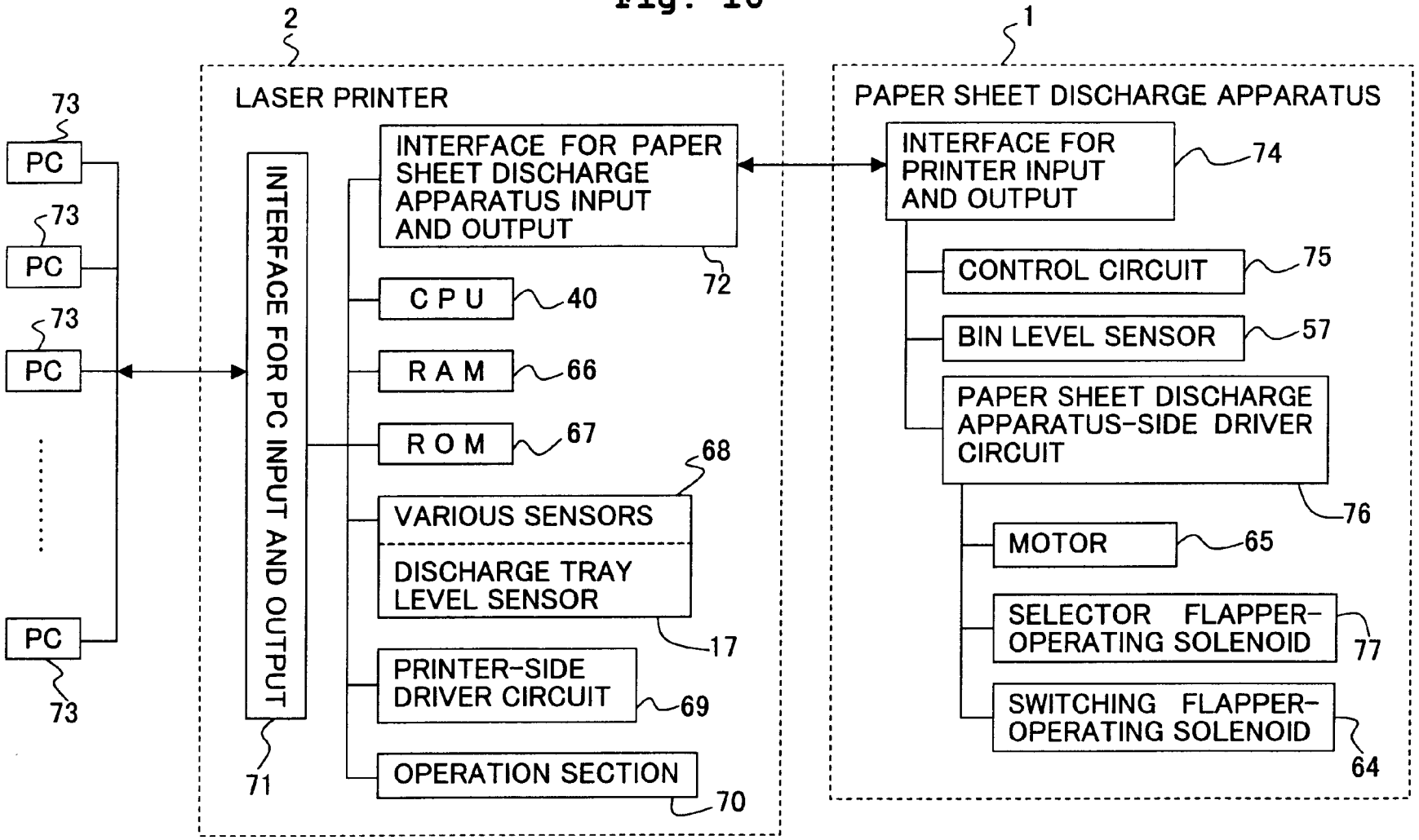
FIG. 10 is a block diagram illustrating control systems of the laser printer and the paper sheet discharge apparatus.

FIG. 10 shows a block diagram illustrating control systems for performing the control as described above. At first, explanation will be made with reference to FIG. 10 for the control systems of the paper sheet discharge apparatus 1 and the laser printer 2.

Elements connected in the control system of the laser printer 2 include respective sections of CPU 40, RAM 66, ROM 67, various sensors 68, a printer-side driver circuit 69, an operation section 70, an interface 71 for PC input and output, and an interface 72 for paper sheet discharge apparatus input and output. RAM 66 is a memory that performs temporary storage, and it stores, for example, received data inputted from an external personal computer (hereinafter referred to as "PC") 73 via the interface 71 for PC input and output, and bitmap data prepared in accordance with the received data. ROM 67 stores various execution programs, and it stores, for example, a conversion program that converts the received data stored in RAM 66 into the bitmap data, a selective discharge control program, a discharge control program, and a sequential discharge control program, as described below. The various sensors include the counter lever 31 and the discharge tray level sensor 17 as described above. The printer side-driver circuit 69 drives and controls electrically driven members of the laser printer 2, such as the motor for driving the various rollers, the laser scanner 133, the image-forming unit 4, and the fixing unit 5, in accordance with the instruction given by CPU 40. The operation section 70 is provided with various input switches and the like.

On the other hand, elements connected to an interface 74 for printer input and output in the control system of the paper sheet discharge apparatus 1 include a control circuit 75, the bin level sensors 57 provided for the respective bins 23, and a paper sheet discharge apparatus-side driver circuit 76. The control circuit 75 controls the paper sheet discharge apparatus-side driver circuit 76 in accordance with the instruction supplied from CPU 40 of the laser printer 2 via the interface 74 for printer input and output and the interface 72 for paper sheet discharge apparatus input and output, and it transmits the detection state of the bin level sensor 57 to CPU 40 of the laser printer 2. The paper sheet discharge apparatus-side driver circuit 76 drives electrically driven members of the paper sheet discharge apparatus 1, such as the motor 65, the selector flapper-operating solenoid 77, and the switching flapper-operating solenoid 64, in accordance with the instruction given by the control circuit 75.

Next, explanation will be made with reference to flow charts shown in FIGS. 11 to 13 for the process executed by CPU 40 by using the control systems as described above in which a predetermined image is formed on the paper sheet to be ultimately discharged in accordance with the execution programs stored in ROM 67 when the received data from the external PC 73 is received by the laser printer 2.

Figure 11:
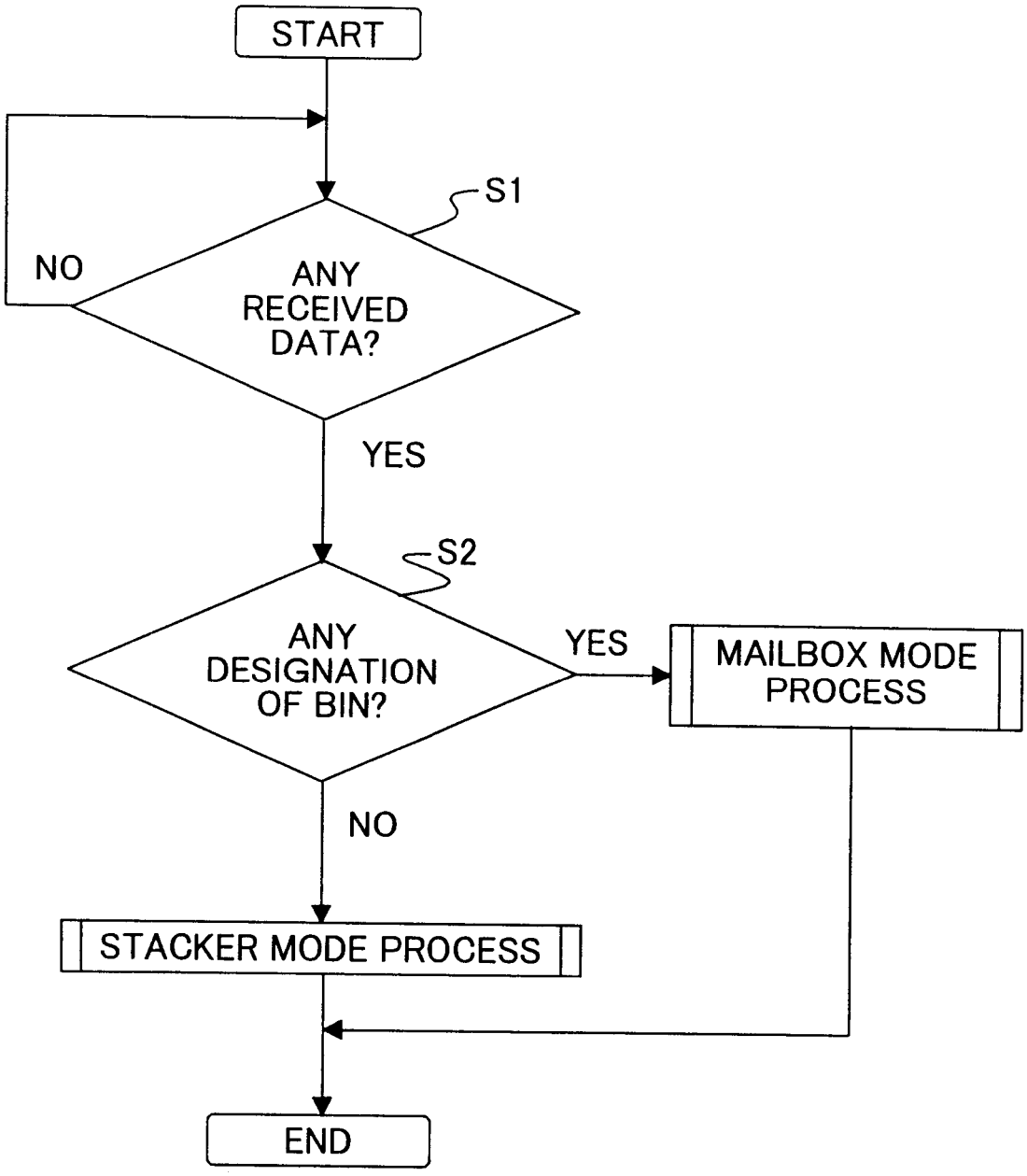
FIG. 11 is a flow chart illustrating a process up to execution of the process in a mailbox mode or a stacker mode when received data is received from external PC by the laser printer.
Figure 12:
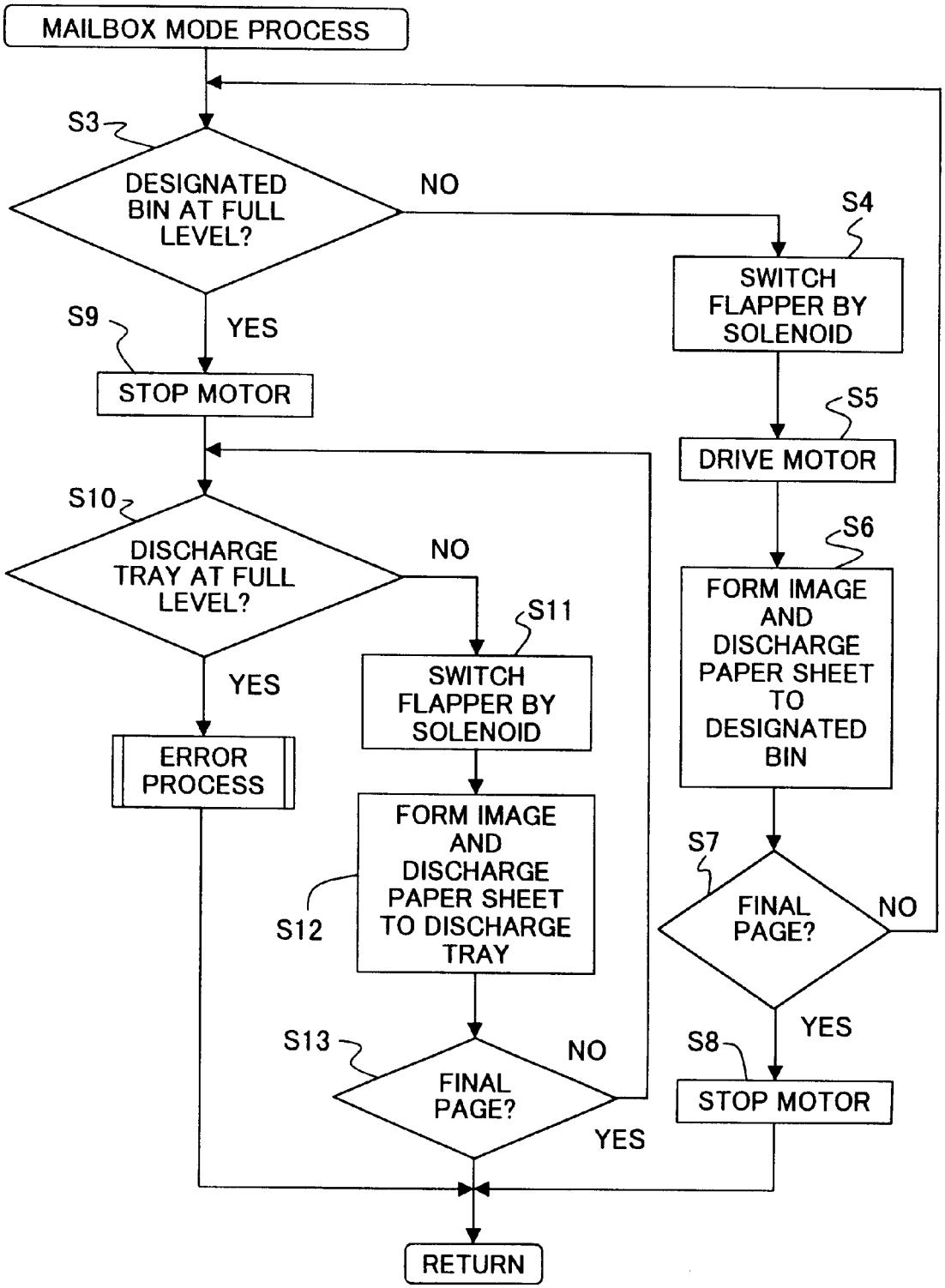
FIG. 12 is a flow chart illustrating the process in the mailbox mode.

At first, reference is made to FIG. 11. If the received data is received in RAM 66 (S1: YES) from the external PC 73 via the interface 71 for PC input and output, it is judged whether or not there is any designation in the received data of the bin 23 for which the delivery operation is performed, i.e., there is any designation of sheet delivery to the specified bin 23 of the first to fifth bins 41 to 45 (S2). If there is a certain designation of the bin 23 (S2: YES), the system executes the mailbox mode process for using the paper sheet discharge apparatus 1 as a so-called mailbox, in which a specified person uses only an allotted bin 23 of the plurality of bins 23. If there is no designation of the specified bin 23 (S2: NO), the system executes the stacker mode process for using the paper sheet discharge apparatus 1 as a stacker in which the paper sheets formed with the predetermined image are successively stored.

Next, explanation will be made with reference to FIG. 12 for the mailbox mode process which is executed when the bin 23 to which the paper sheets are discharged is designated (S2: YES). At first, it is judged whether or not there is any detection of the fall level concerning the bin level sensor 57 for the designated bin 23 (S3). If the bin level sensor 57 for the designated bin 23 does not detect the full level (S3: NO), then the selector flapper-operating solenoid 77 is first operated to allow the selector flapper 12 to make swinging movement to the introducing passage-side guide position so that the paper sheet may be guided from the introducing passage-side guide passage 19 into the introducing passage 21. The switching flapper-operating solenoids 64 are also operated so that only the selector flapper 25 corresponding to the designated bin 23 is allowed to make swinging movement to the delivery-directed guide position, and the other flappers 25 are allowed to make swinging movement to the vertically directed guide position (S4). Thus, a state is provided, in which the paper sheet can be guided to the delivery rollers 22 corresponding to the designated bin 23. Subsequently, the motor 65 of the paper sheet discharge apparatus I is driven to rotate and drive the delivery rollers 22 and the transport rollers 24 (5S). The image-forming operation is executed by the laser printer 2 to discharge the paper sheet on which the predetermined image is formed. The paper sheet, which is discharged from the laser printer 2, is introduced into the paper sheet discharge apparatus 1, and it is discharged to the designated bin 23 (S6). These processes (processes ranging from S3 to S6) are repeated until images of all pages included in the received data are formed, i.e., until arrival at the final page (S7: NO). If the process for the final page is completed (S7: YES), then the driving operation of the motor 65 is stopped (S8), and the process comes to an end.

On the other hand, if the bin level sensor 57 for the designated bin 23 of the paper sheet discharge apparatus 1 detects the full level (S3: YES), the driving of the motor 65 of the paper sheet discharge apparatus 1 is stopped (S9). Then, the judgment is made to determine the presence or absence of the detection of the full level effected by the discharge tray level sensor 17 for detecting the full level of the discharge tray 16 of the laser printer 2 (S10). If the full level is not detected by the discharge tray level sensor 17 (S10: NO), the selector flapper-operating solenoid 77 is operated to allow the selector flapper 12 to make swinging movement to the discharge tray-side guide position so that the paper sheet is guided to the discharge tray-side guide passage 18 (S11). Subsequently, the image-forming operation is executed by the laser printer 2. The paper sheet, on which the predetermined image is formed, is discharged onto the discharge tray 16 (S12). These processes (processes ranging from S10 to S12) are repeated until arrival at the final page (S13: NO). If the process for the final page is completed (S13: YES), then the process comes to an end, and the system is in a state of waiting for the next job. If the full level is detected by the discharge tray level sensor 17 (S10: YES), it is impossible to discharge the paper sheet to both of the designated bin 23 of the paper sheet discharge apparatus 1 and the discharge tray 16 of the laser printer 2. Therefore, the image-forming operation is not executed. A predetermined error process is executed to inform the user of the fact that the paper sheet cannot be discharged.

In the embodiment of the invention, when the designated bin 23 of the paper sheet discharge apparatus 1 is filled with the paper sheets making it impossible to store any more paper sheet, if the discharge tray 16 of the laser printer 2 is not filled with the paper sheets, then the paper sheets are continuously discharged to the discharge tray 16. Therefore, the frequency of interruption is reduced, as compared with a case in which the image-forming operation is interrupted every time when the designated bin 23 is filled with the paper sheets.

Figure 13A:
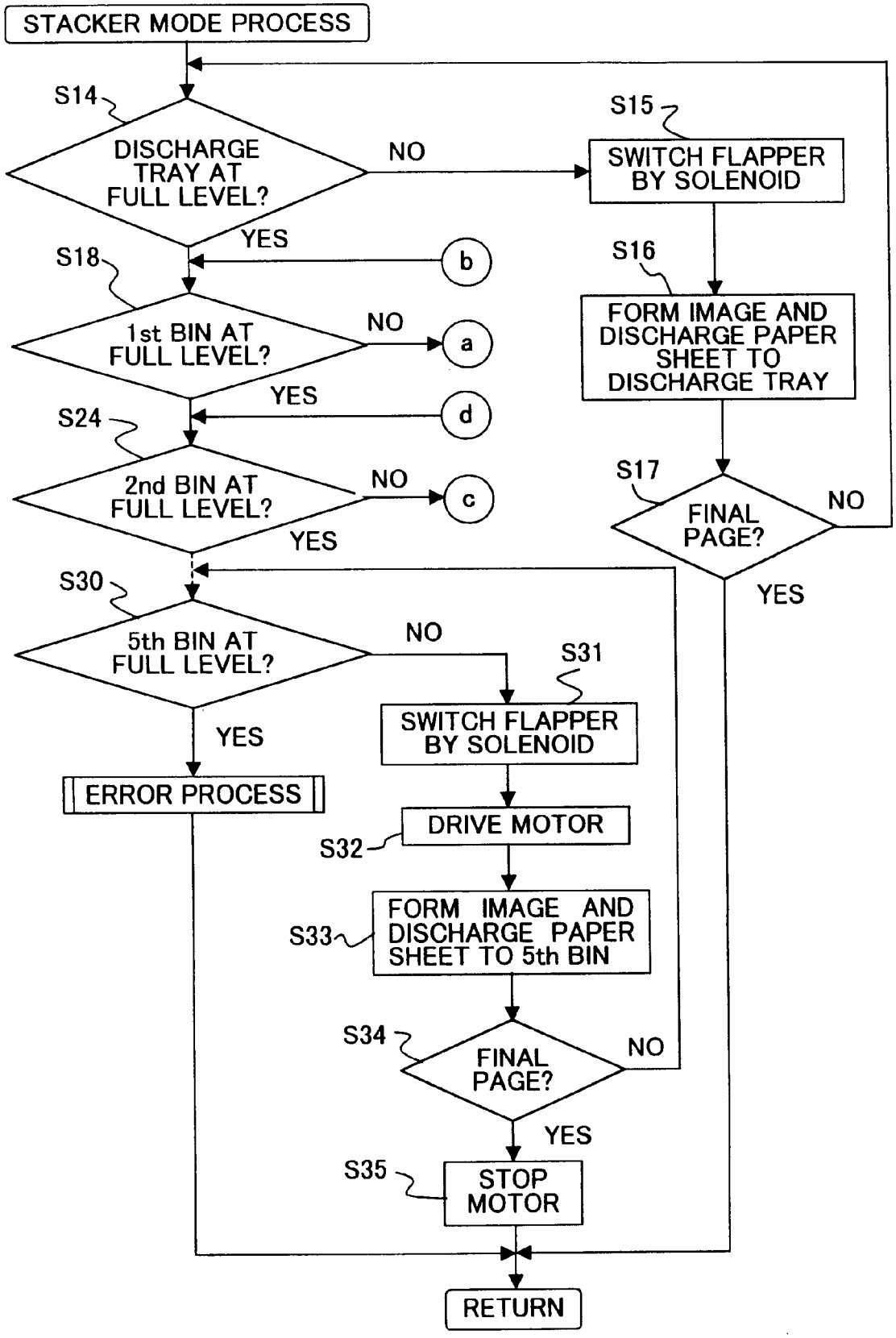
FIGS. 13A and 13B are flow charts illustrating the process in the stacker mode.
Figure 13B:
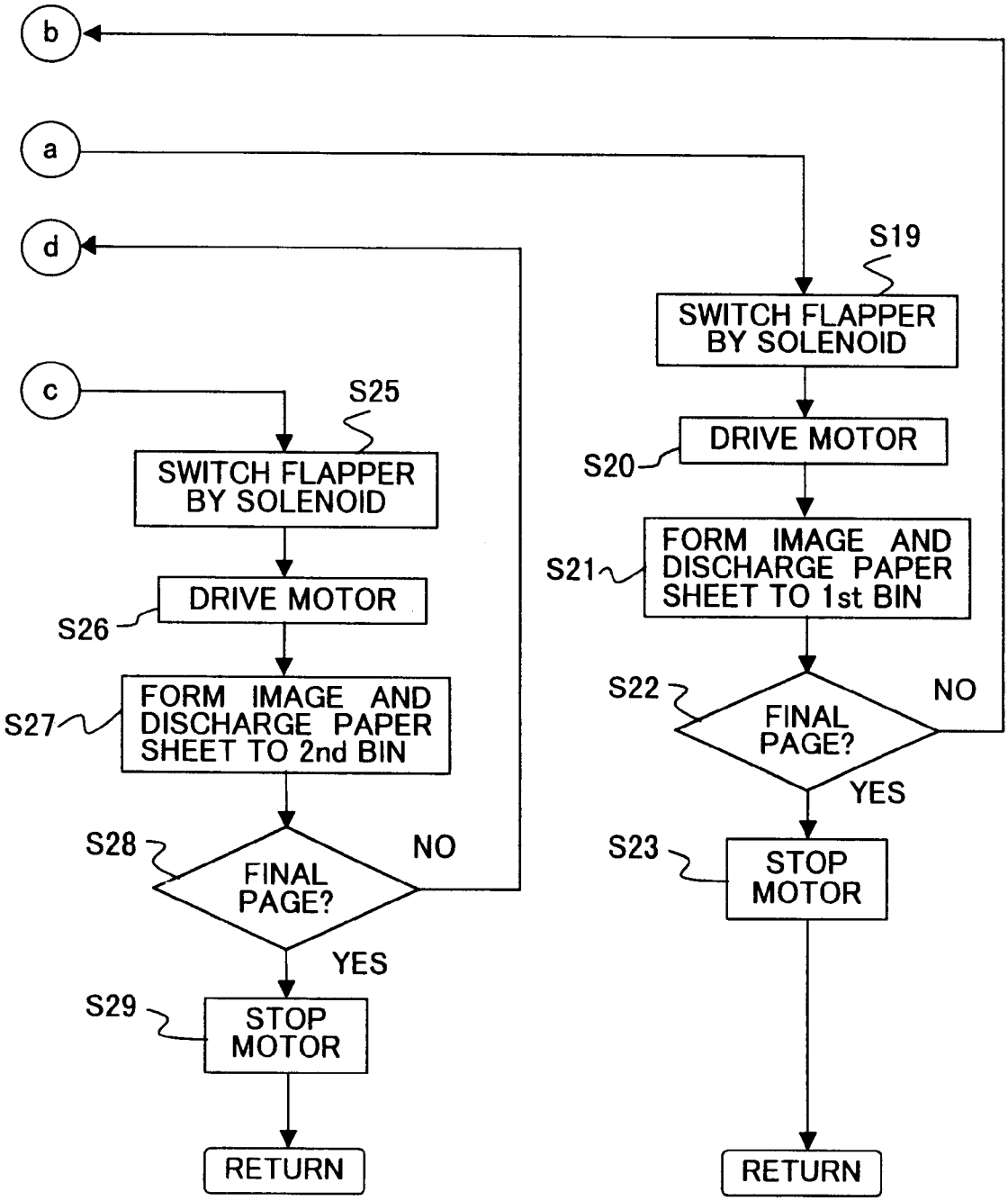

Next, the stacker mode process will be explained with reference to FIGS. 13A and 13B. This process is executed by using the selective discharge control program stored in ROM 67, the discharge control program as a discharge control device, and the sequential discharge control program as a sequential discharge control device. If the bin 23 to which the paper sheet is discharged is not designated in FIG. 11 (S2: NO), the stacker mode process shown in FIGS. 13A and 13B is executed. In the stacker mode process, the judgment is first made to determine the presence or absence of the detection of the full level by the discharge tray level sensor 17 for detecting the full level of the discharge tray 16 of the laser printer 2 (S14). If the full level is not detected by the discharge tray level sensor 17 (S14: NO), then the selector flapper-operating solenoid 77 is operated, and the selector flapper 12 is allowed to make swinging movement to the discharge tray-side guide position so that the paper sheet is guided to the discharge tray-side guide passage 18 (S15). Subsequently, the image-forming operation is executed by the laser printer 2. The paper sheet, on which the predetermined image is formed, is discharged onto the discharge tray 16 (S16). These processes (ranging from S14 to S16) are repeated until arrival at the final page (S17: NO). If the process for the final page is completed (S17: YES), the process comes to an end.

On the other hand, if the discharge tray level sensor 17 detects the full level (S14: YES), the paper sheet cannot be discharged to the discharge tray 16 of the laser printer 2. Therefore, it is subsequently judged whether or not the bin level sensor 57 corresponding to the first bin 41 disposed at the lowermost position of the paper sheet discharge apparatus 1 detects the full level (S18). If the bin level sensor 57 corresponding to the first bin 41 does not detect the full level (S18: NO), then the selector flapper-operating solenoid 77 is first operated, and the selector flapper 12 is allowed to make swinging movement to the introducing passage-side guide position so that the paper sheet may be guided from the introducing passage-side guide passage 19 into the introducing passage 21. Further, the respective switching flapper-operating solenoids 64 are operated so that only the first flapper 35 is allowed to make swinging movement to the delivery-directed guide position, and the other second to fifth flappers 36 to 39 are allowed to make swinging movement to the vertically directed guide position (S19) to provide a state in which the paper sheet can be guided to the transport rollers 22 corresponding to the first bin 41. Subsequently, the motor 65 of the paper sheet discharge apparatus 1 is driven to rotate and drive the delivery rollers 22 and the transport rollers 24 (S20). The image-forming operation is executed by the laser printer 2, and the paper sheet, on which the predetermined image is formed, is discharged. The paper sheet, which is discharged from the laser printer 2, is introduced into the paper sheet discharge apparatus 1, and it is discharged to the first bin 41 (S21). These processes (ranging from S18 to S21) are repeated until arrival at the final page (S22: NO). If the process for the final page is completed (S22: YES), then the driving operation of the motor 65 is stopped (S23), and the process comes to an end.

Next, if the bin level sensor 57 corresponding to the first bin 41 of the paper sheet discharge apparatus 1 detects the full level (S18: YES), it is impossible to discharge the paper sheet to the discharge tray 16 of the laser printer 2 and the lowermost first bin 41 of the paper sheet discharge apparatus 1. Therefore, it is subsequently judged whether or not the bin level sensor 57 corresponding to the second bin 42 disposed at the second position from the bottom of the paper sheet discharge apparatus 1 detects the full level (S24). If the bin level sensor 57 corresponding to the second bin 42 does not detect the full level (S24: NO), the following operation is performed in the same manner as performed for the first bin 41. That is, the selector flapper-operating solenoid 77 is firstly operated, and the selector flapper 12 is allowed to make swinging movement to the introducing passage-side guide position so that the paper sheet may be guided from the introducing passageside guide passage 19 into the introducing passage 21. Further, the respective switching flapper-operating solenoids 64 are operated so that only the second flapper 36 is allowed to make swinging movement to the delivery-directed guide position, and the other first to third and fifth flappers 35, 37 to 39 are allowed to make swinging movement to the vertically directed guide position (S25) to provide a state in which the paper sheet can be guided to the transport rollers 22 corresponding to the second bin 42. Subsequently, the motor 64 of the paper sheet discharge apparatus 1 is driven to rotate and drive the delivery rollers 22 and the transport rollers 24 (S26). The image-forming operation is executed by the laser printer 2, and the paper sheet, on which the predetermined image is formed, is discharged. The paper sheet, which is discharged from the laser printer 2, is introduced into the paper sheet discharge apparatus 1, and it is discharged to the second bin 42 (S27). These processes (ranging from S24 to S27) are repeated until arrival at the final page (S28: NO). If the process for the final page is completed (S28: YES), then the driving operation of the motor 65 is stopped (S29), and the process comes to an end.

Next, if the bin level sensor 57 corresponding to the second bin 42 of the paper sheet discharge apparatus 1 detects the full level (S24: YES), it is subsequently judged whether or not the bin level sensor 57 corresponding to the third bin 43 disposed at the third position from the bottom detects the full level. If the bin level sensor 57 corresponding to the third bin 43 does not detect the full level, the paper sheet is discharged to the third bin 43 in accordance with the same process as performed for the first and second bins 41, 42 described above. Further, if the bin level sensor 57 corresponding to the third bin 43 detects the full level, the paper sheet is subsequently discharged to the fourth bin 44 disposed at the fourth position from the bottom. If the bin level sensor 57 corresponding to the fourth bin 44 detects the full level, it is judged whether or not the bin level sensor 57 corresponding to the uppermost fifth bin 45 detects the full level (S30). If the full level is not detected (S30: NO), the paper sheet is discharged to the fifth bin 45 (S30 to S35) in accordance with the same process as performed for the first to fourth bins 41 to 44 described above. If the bin level sensor 57 corresponding to the fifth bin 45 detects the full level (S30: YES), it is impossible to discharge the paper sheet to the discharge tray 16 of the laser printer 2 and all of the bins 41 to 45 of the paper sheet discharge apparatus 1. Therefore, the image-forming operation is not executed. A predetermined error process is executed to inform the user of the fact that the paper sheet cannot be discharged.

As described above, when the control is made in the foregoing manner in the stacker mode, the discharge tray level sensor 17 detects the full level if the discharge tray 16 is filled with the paper sheets during the process in which the paper sheet, on which the predetermined image is formed, is discharged to the discharge tray 16. The selective discharge control program is executed to automatically switch the selector flapper 12 so that the paper sheet is guided to the introducing passage 21 of the paper sheet discharge apparatus 1. Accordingly, no excessive paper sheet, which exceeds a predetermined storage amount, is stacked on the discharge tray 16. The paper sheets corresponding to the excessive amount can be successfully stored in the bin 23.

The discharge control program is executed as follows. That is, if the specified bin 23, to which the paper sheet is transported, is filled with the paper sheets, the bin level sensor 57 detects the full level. Subsequently, the switching flapper 25 is switched so that the paper sheet is transported to another bin 23 for which the bin level sensor 57 does not detect the full level, i.e., another bin 23 which is not filled with the paper sheets. Accordingly, if the specified bin 23 is filled with the paper sheets, the paper sheet is automatically and successively transported to another bin 23 which is not filled with the paper sheets. Therefore, no excessive paper sheet, which exceeds a predetermined storage amount, is stacked on each of the bins 23. The paper sheets can be successfully stored in the respective bins 23. Further, in the embodiment of the present invention, the sequential discharge program is executed as follows. That is, the paper sheets are successively transported in the order starting from the lowermost bin 23 of the first to fifth bins 41 to 45 aligned in the vertical direction, and the paper sheets are successively stored in the respective bins 23. Therefore, the stored paper sheets are not stored in the plurality of bins 23 in a random state, but the paper sheets can be stored in a regular state. Thus, it is possible to realize efficient storage.

Further, in order to increase the paper sheet storage amount of the paper sheet discharge apparatus 1, an arbitrary bin 23 or arbitrary bins 23 disposed over the lowermost first bin 41 may be removed. Even in such a situation, the discharge destination of the paper sheet is switched depending on the detection of the full level effected by the bin level sensor 57 for each of the bins 23 starting from the delivery rollers 22 corresponding to the lowermost bin 41 and successively being changed to the delivery rollers 22 corresponding to the upper bins 23. Therefore, when the paper sheet is discharged from the respective delivery rollers 22, the falling distance of the paper sheet to the bin 23 is never increased. Thus, the paper sheets can be reliably stored in an aligned state.

The driving mechanism of the paper sheet discharge apparatus 1 will now be explained in further detail with reference to FIG. 3 and FIGS. 14 and 15. With reference to FIG. 3, the upper casing 28 has one side and another side, with the bin 23 intervening therebetween. A gear box 97 to be used to drive the delivery rollers 22 and the transport rollers 24 are arranged on one side, and the switching flapper-operating solenoid 64 that drives the switching flapper 25 is arranged on the other side. The motor 65, which serves as a driving source that drives the delivery rollers 22 and the transport rollers 24, is arranged on the side on which the switching flapper-operating solenoid 64 is arranged. The motor 65 drives, via a reduction gear array 96, a roller shaft 80 of the transport rollers 24, the roller shaft 80 extending into the inside of the gear box 97 disposed on the other side.

Figure 14:
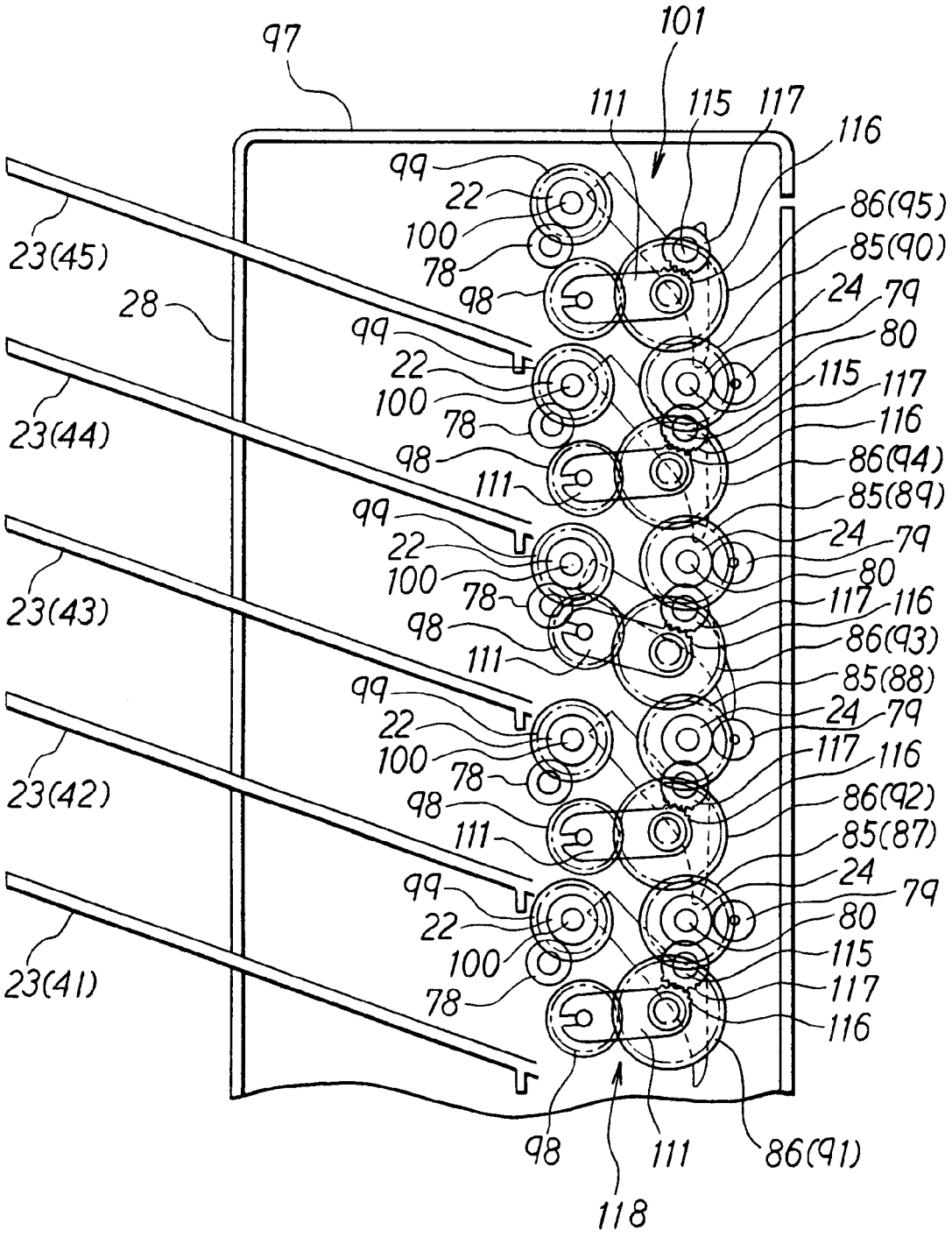
FIG. 14 is a cross-sectional side view of main components as viewed from a side of a gear box shown in FIG. 3.
Figure 15:
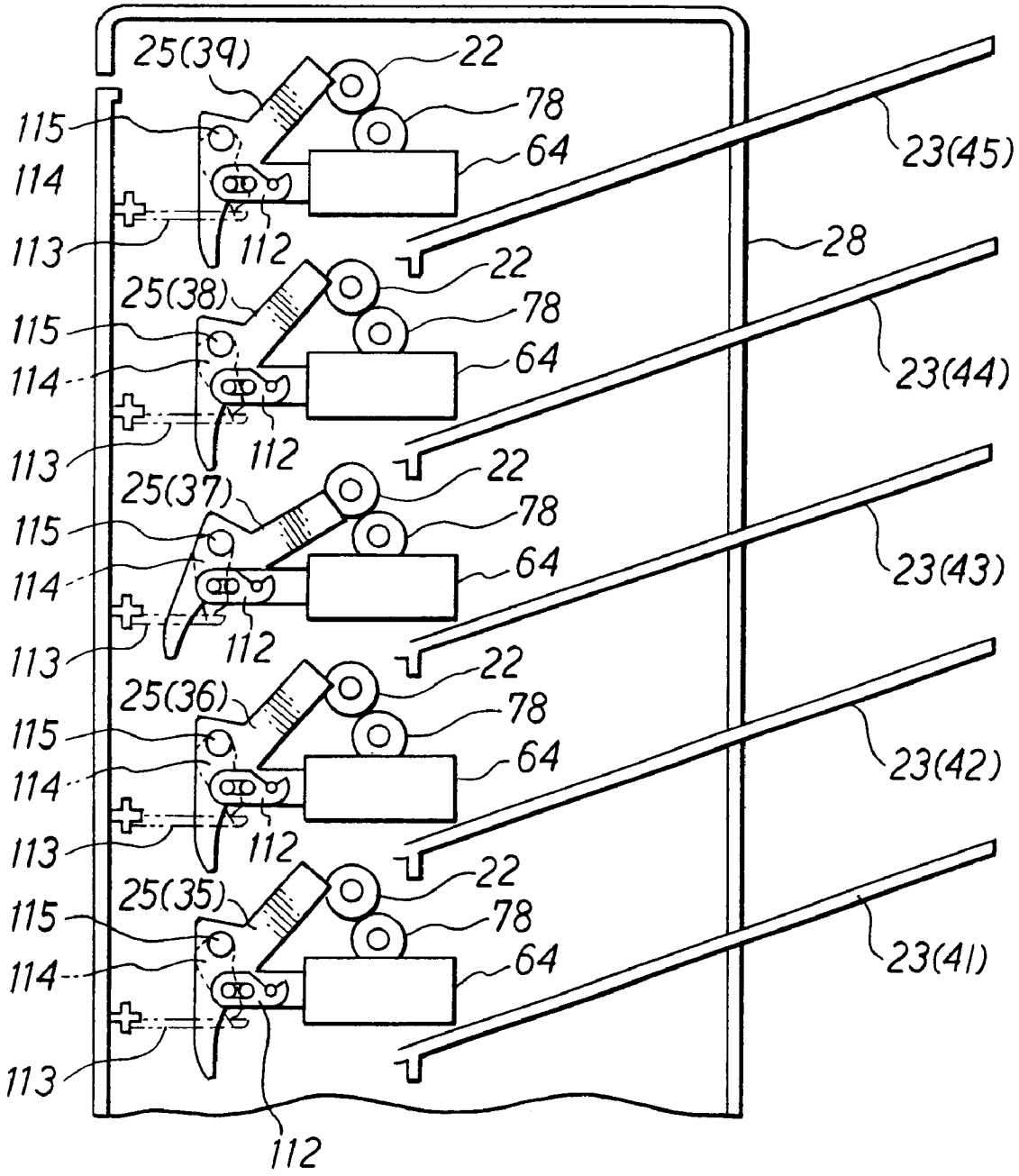
FIG. 15 is a cross-sectional side view of main components as viewed from a side of a solenoid shown in FIG. 3.

As shown in FIG. 14, the gear box 97 accommodates a roller-driving gear array 101 that transmits power to drive the delivery rollers 22 and the transport rollers 24. The roller-driving gear array 101 comprises transport roller gears 85 which are provided at shaft ends of the roller shafts 80 of the respective transport rollers 24 (in the following description, when the transport roller gears 85 are distinguished from each other, they are referred to as first to fourth transport roller gears 87 to 90 in an order starting from the lowest transport roller gear), intermediate gears 86 which are engaged with the respective transport roller gears 85 (in the following description, when the intermediate gears 86 are distinguished from each other, they are referred to as first to fifth intermediate gears 91 to 95 in an order starting from the lowest intermediate gear), clutch gears 98 which are engaged with the respective intermediate gears 86, and delivery roller gears 99 which are provided at shaft ends of roller shafts 100 of the respective delivery rollers 22 and which are engaged with the respective clutch gears 98.

The power, which is inputted from the roller shaft 80 of the transport rollers 24 into the roller-driving gear array 101, is transmitted via the respective intermediate gears 86 to the respective delivery roller gears 85. The roller shafts 80 of the respective transport rollers 24 are driven, and the respective transport rollers 24 are rotated. That is, the power, which is inputted from the motor 65 into the roller shaft 80 on which the first transport roller gear 87 is provided, is transmitted via the first transport roller gear 87 to the first intermediate gear 91 and the second intermediate gear 92 which are engaged therewith at upper and lower positions respectively. The power, which is transmitted to the second intermediate gear 92, is transmitted to the second transport roller gear 88, which is engaged therewith on its upper side. Accordingly, the roller shaft 80, on which the second transport roller gear 88 is provided, is driven. The power is transmitted from the second transport roller gear 88 via the third intermediate gear 93, which is engaged therewith on its upper side, to the third transport roller gear 89 which is engaged therewith on the upper side of the third intermediate gear 93. Accordingly, the roller shaft 80, on which the third transport roller gear 89 is provided, is driven. The power is transmitted from the third transport roller gear 89 via the fourth intermediate gear 94, which is engaged therewith on its upper side, to the fourth transport roller gear 90 which is engaged therewith on the upper side of the fourth intermediate gear 94. Accordingly, the roller shaft 80, on which the fourth transport roller gear 90 is provided, is driven. The power is transmitted from the fourth transport roller gear 90 to the fifth intermediate gear 95 which is engaged therewith on its upper side.

On the other hand, the power is transmitted to the respective delivery rollers 22 by the aid of swinging mechanisms 118 operable as selective transmitting devices. The swinging mechanism 118 comprises the intermediate gear 86, the clutch gear 98, the delivery roller gear 99, and a swinging arm 111, which is coupled to the clutch gear 98 at one end and which is coupled to the intermediate gear 86 at the other end. Of these components, the clutch gear 98 and the delivery roller gear 99 as a mode-switching means are subjected to engagement, or they are released from engagement. Thus, the power can be transmitted or cut off. That is, the clutch gear 98 is held on the intermediate gear 86 by the aid of the swinging arm 111. The clutch gear 98 is swingable about a support point of the shaft of the intermediate gear 86 around the intermediate gear 86, between an engaged position with respect to the delivery roller gear 99 (position indicated by the clutch gear 98 held by the third intermediate gear 93 in FIG. 14), and a released position (position indicated by the clutch gears 98 held by the intermediate gears 86 other than the third intermediate gear 93 in FIG. 14). A swinging gear section 116, which is engaged with a switching gear 117 as described below, is formed around the side of the intermediate gear 86. The swinging action of the clutch gear 98 is interlocked with the switching action of the switching flapper 25 described below.

The switching action of the switching flapper 25 will be explained with reference to FIG. 15. In FIG. 15, each of the switching flappers 25 is provided with the switching flapper-operating solenoid 64. The switching flapper-operating solenoid 64 is coupled to the switching flapper 25 via a link 112. Each of the switching flappers is provided integrally with a spring hook 114 that fastens a spring 113. One end of the spring 113 is fastened to the upper casing 28, and the other end of the spring 113 is fastened to the spring hook 114. The switching flappers 25, which correspond to the bins 23 to which the paper sheet is not discharged, are allowed to make swinging movement about the support points of the flapper shafts 115 to the vertically directed guide positions by the aid of the action of the switching flapper-operating solenoids 64 (state indicated by the switching flappers 25 other than the third flapper 37 in FIG. 15). The switching flapper 25, which corresponds to the bin 23 to which the paper sheet is discharged, is allowed to make swinging movement to the delivery-directed guide position (state indicated by the third flapper 37 in FIG. 15) by the aid of the urging force of the spring 113 by deenergizing the action of the switching flapper-operating solenoid 64.

As described above with reference to FIG. 14, the switching gear 117, which is engaged with the swinging gear section 116 formed on the swinging arm 111, is provided integrally with the flapper shaft 115 around the flapper shaft 115 of the switching flapper 25. The engagement of the switching gear 117 with the swinging gear section 116 allows the switching action of the switching flapper 25 to be interlocked with the swinging action of the clutch gear 98. That is, when the switching flapper 25 makes swinging movement to the vertically directed guide position in accordance with the operation of the switching flapper-operating solenoid 64, then the switching gear 117 is also rotated in accordance with the rotation of the flapper shaft 115, and the swinging arm 111, which has the swinging gear section 116 engaged with the switching gear 117, is also subjected to swinging movement. The swinging movement of the swinging arm 111 allows the clutch gear 98 to make swinging movement in the direction to make separation from the delivery roller 99 (downward direction in FIG. 14), i.e., to the released position at which the engagement between the delivery roller gear 99 and the clutch gear 98 is released.

On the other hand, when the operation of the switching flapper-operating solenoid 64 is deenergized, and the switching flapper 25 makes swinging movement to the delivery-directed guide position by the aid of the urging force of the spring 113, the flapper shaft 115 is then rotated in a direction opposite to the direction of swinging movement of the switching flapper 25 to the vertically directed guide position. The rotation allows the swinging arm 111 to make swinging movement as well in the opposite direction (upward direction in FIG. 14) by the aid of the switching gear 117. The swinging movement of the swinging arm 111 allows the clutch gear 98 to make swinging movement to the engaged position at which the clutch gear 98 is engaged with the delivery roller gear 99.

FIG. 14 shows the following state. That is, the clutch gear 98, which is held by the third intermediate gear 93, makes swinging movement to the engaged position to make engagement with the delivery roller gear 99 while being interlocked with the swinging movement of the third flapper 37 to the delivery-directed guide position. The clutch gears 98, which are held by the first, second, fourth, and fifth intermediate gears 91, 92, 94, 95 respectively, make swinging movement to the released positions to release engagement with the delivery roller gears 99 while being interlocked with the swinging movement of the first, second, fourth, and fifth switching flappers 35, 36, 38, 39 other than the third flapper 37 to the vertically directed guide positions. In this embodiment, only the delivery rollers 22 corresponding to the third flapper 37 are driven, and the other delivery rollers 22 are not driven.

According to the structure as described above, the power from the motor 65 is not transmitted to all of the delivery rollers 22. Instead, the swinging mechanism 118 can be used to selectively transmit the power to only the specified delivery rollers 22 which are used to discharge the paper sheet of the plurality of delivery rollers 22. Accordingly, it is possible to diminish the load on the motor 65 as compared with a case in which all of the delivery rollers 22 are commonly driven. Therefore, it is unnecessary to use an expensive motor capable of outputting large power. Further, it is possible to decrease the electric power consumption required to drive the motor. Thus, it is possible to reduce the cost of the apparatus. Further, the number of driven members is reduced as compared with a case in which all of the delivery rollers 22 are always driven. Thus, it is possible to reduce the driving sound during the operation.

Further, the swinging mechanism 118 realizes the selective power transmission by using such a simple mechanism that the delivery roller gear 99 and the clutch gear 98 are subjected to engagement, or they are released from engagement so that the power is transmitted to only the specified delivery rollers 22 which are used to discharge the paper sheet, and the power transmission to the other delivery rollers 22 is cut off. Furthermore, the operation is performed such that the delivery roller gear 99 and the clutch gear 98 are subjected to engagement, or they are released from engagement while being interlocked with the switching action of the switching flapper 25. Therefore, it is unnecessary to provide any special equipped mechanism, such as a solenoid for switching the engagement and the release from engagement between the delivery roller gear 99 and the clutch gear 98. Thus, it is possible to selectively transmit the driving power to only the delivery rollers 22, which are used to discharge the paper sheet, by using the simple mechanism.

Further, the roller-driving gear array 101 is used to transmit the power from the motor 65 to the transport rollers 24, and the swinging mechanism 118 is used to selectively transmit the power to the delivery rollers 22. Therefore, the transport rollers 22 and the delivery rollers 22 can be driven by using one motor 65.

Further, the following effect is also obtained in the case of using the stacker as shown in FIG. 6. With reference to FIG. 6, driven rollers 78 of the delivery rollers 22, which correspond to the removed second to fourth bins 42 to 44 respectively, contact with the stacked paper sheets. In such a situation, if all of the delivery rollers 22 are commonly driven, then the delivery rollers 22, which correspond to the driven rollers 78 contacting with the stacked paper sheets, are also driven, and the load on the motor 65 is extremely increased. Rearward ends of the paper sheets contacting with the driven rollers 78 are bent or dirtied to cause damage due to the rotation of the delivery rollers 22.

On the contrary, in the embodiment of the invention, the swinging mechanism 118 is used to selectively drive only the specified delivery rollers 22 which are used to discharge the paper sheet (for example, the delivery rollers 22 corresponding to the fifth bin 45 in FIG. 6). Accordingly, the delivery rollers 22 (for example, the delivery rollers 22 corresponding to the first to fourth bins 41 to 44 in FIG. 6), which correspond to the driven rollers 78 contacting with the stacked paper sheets, are not driven. Therefore, the load on the motor 65 is never increased by driving the delivery rollers 22 corresponding to the driven rollers 78 contacting with the paper sheets. Further, the paper sheets, which contact with the driven rollers 78, are not damaged as well.

Figure 16:
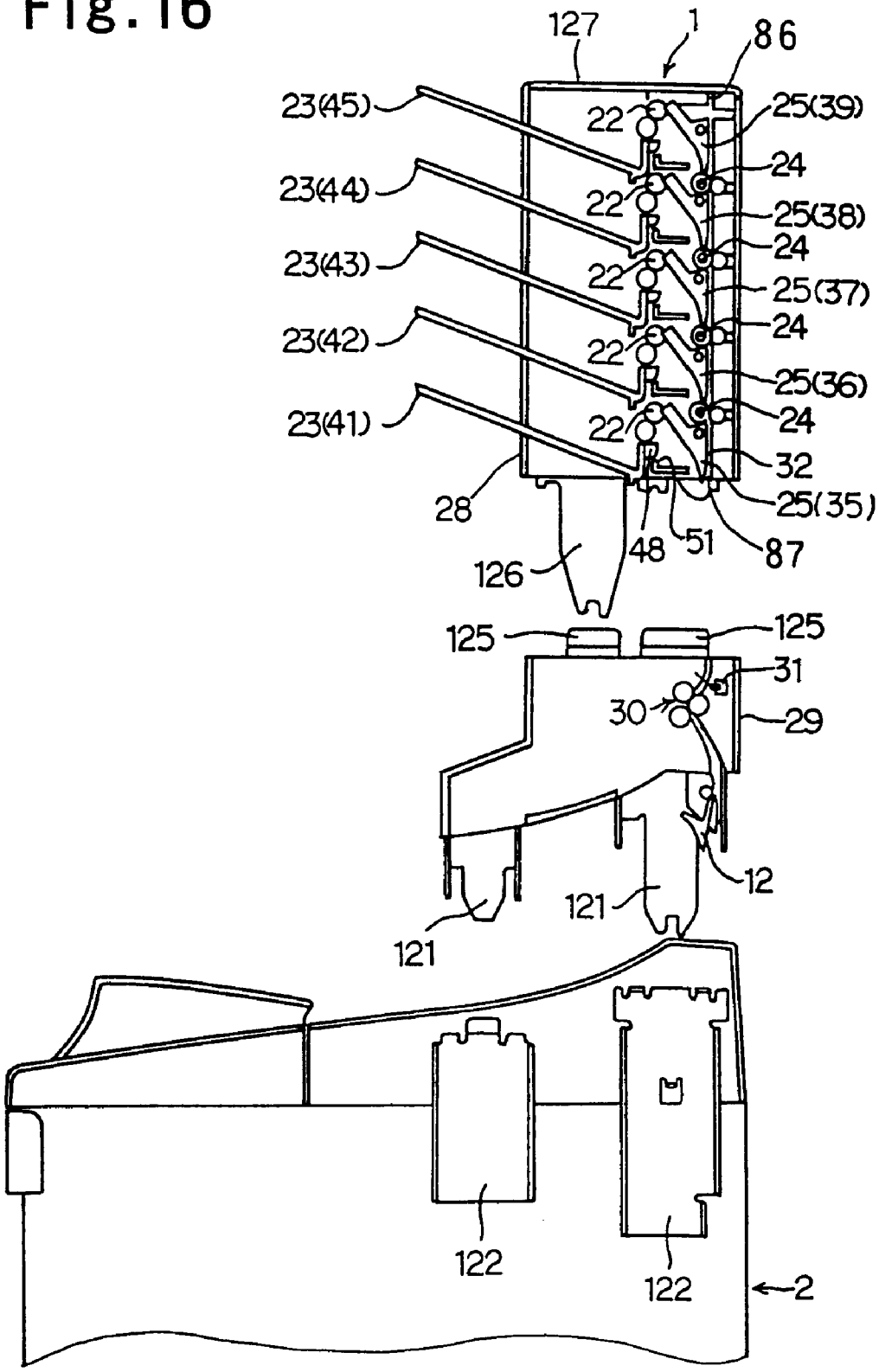
FIG. 16 is a side view of main components which shows a lower casing formed with plural second attaching plates which project above the lower casing.
Figure 17:
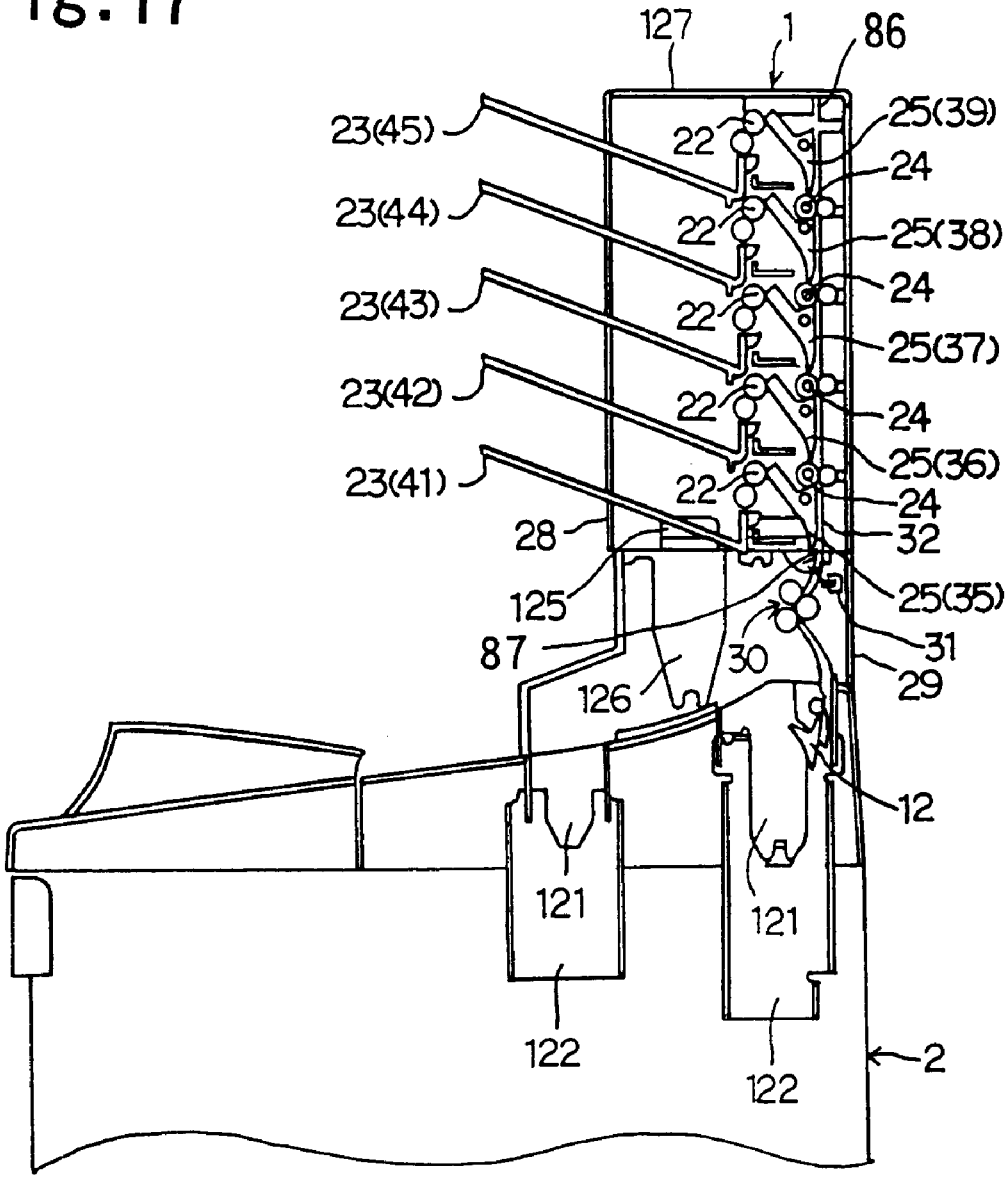
FIG. 17 is a side view of main components which shows an upper casing attached to the lower casing.

The lower casing 29 and the upper casing 28 are separately constructed and detachably attached to each other. As shown in FIG. 16, the lower casing 29 is formed with multiple first attaching plates 121 which project below the lower casing 29. Inside of an upper portion of the laser printer 2, multiple supporting plates 122 are formed, which fittingly position the multiple first attaching plates 121. As shown in FIG. 17, the lower casing 29 is attached to the laser printer 2 in a manner that each plural first attaching plate 121 is fit with each plural supporting plate 122 respectively by inserting each of the multiple first attaching plates 121 into each plural supporting plate 122 from the upper side of the laser printer 2. And the lower casing 29 is removed from the laser printer 2 in a manner that each of the multiple first attaching plates 121 is pulled out from each of the multiple supporting plates 122, respectively, by lifting the lower casing 29 from the laser printer 2.

As shown in FIG. 16, the lower casing 29 is formed with multiple second attaching plates 125 which project above the lower casing 29. In a lower portion of the upper casing 28, multiple third attaching plates 126 are formed with penetrating below the upper casing 28, which are to be attached to the lower casing 29. And as shown in FIG. 17, the upper casing 28 is attached and positioned to the lower casing 29 by inserting each of the multiple second attaching plates 125 into inside of the upper casing 28 and inserting each of the multiple third attaching plates 126 into inside of the lower casing 29. And the upper casing 28 is removed from the lower casing 28 in a manner that each of the multiple second attaching plates 125 is pulled out from inside of the upper casing 28 and each of the multiple third attaching plates 126 is pulled out from inside of the lower casing 29 by lifting the upper casing 28 from the lower casing 29.

Although only the supporting plate 122, the first attaching plate 121, the second attaching plate 125 and the third attaching plate 126, which are formed on one side of the laser printer 2 and the paper sheet discharge apparatus 1, are shown in FIGS. 16 and 17, the supporting plate 122, the first attaching plate 121, the second attaching plate 125 and the third attaching plate 126 are formed on the other side of them in a similar way.

Figure 20:
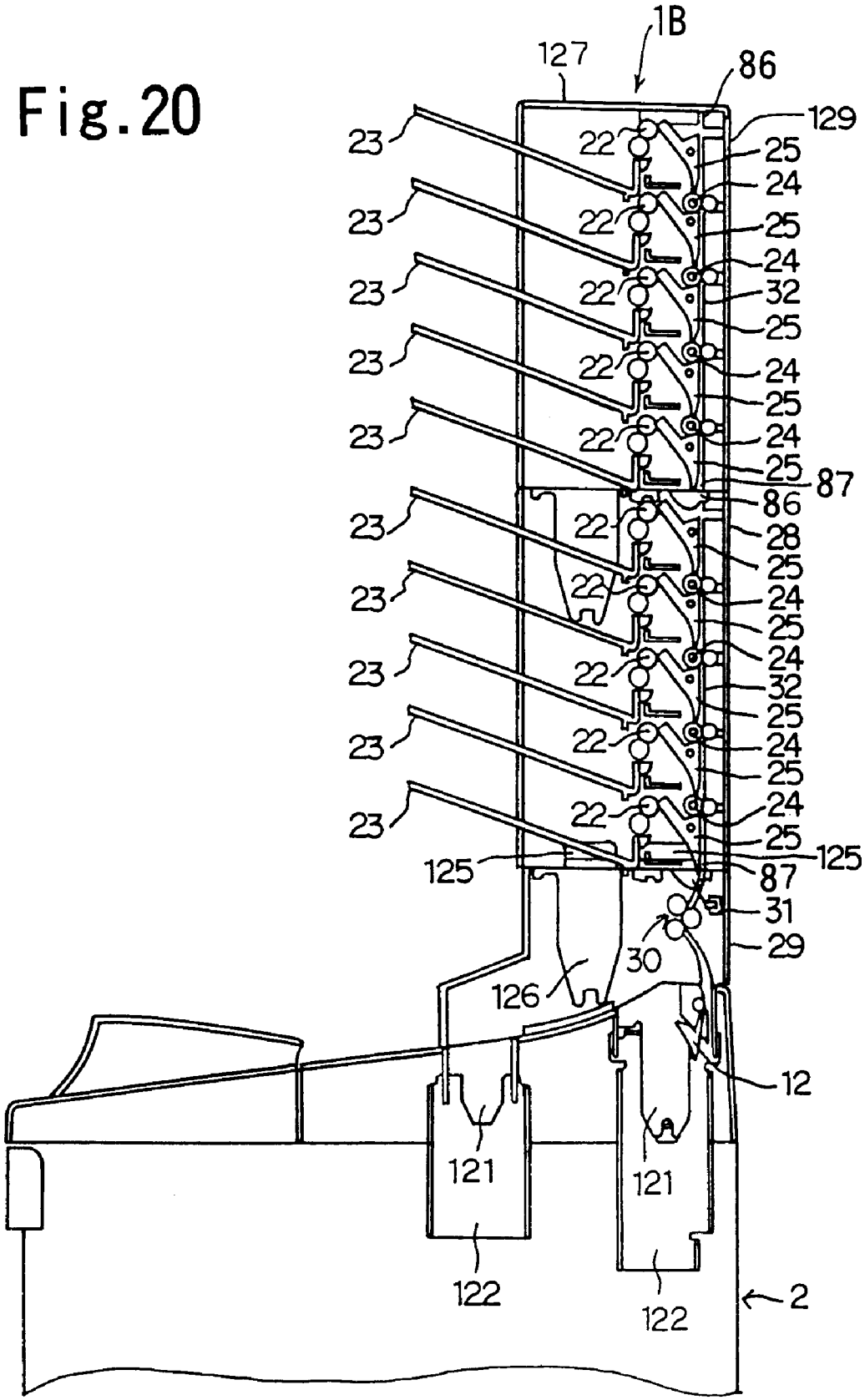
FIG. 20 is a side view of main components which shows a lower casing formed with a first attaching plate which fits with a supporting plate of a laser printer different from that of FIG. 16.

A laser printer 2A shown in FIG. 20 is different from the laser printer 2 shown in FIGS. 16 and 17 in its construction of an upper portion and in position, number and shape of each supporting plate 122A. However, construction of the lower portion of the lower casing 29A and each first attaching plate 121A are formed to be fit with the upper portion and each supporting plate 122A of the laser printer 2A. Also, construction of an upper portion of the lower casing 29A is formed to be fit with the upper casing 28 in a similar way of the above description.

Therefore, the lower casings 29 and 29A are inserted between the upper casing 28 and the laser printer 2 and 2A, respectively, so that they operate as an adaptor for the upper casing 29.

As constructed in the above manner, the paper sheet discharge apparatus 1 can be attached with the other type of laser printer 2A by selecting the appropriate lower casing 29A from multiple types of lower casings 29 and 29A and replacing inappropriate lower casings 29 with the selected lower casing 29A which complies with the laser printer 2A to which the paper sheet discharge apparatus 1 is to be attached. Namely, it is not necessary to exchange the entire paper sheet discharge apparatus 1, and instead it can be sufficient to only exchange the lower casing 29 when the paper sheet discharge apparatus 1 is attached to the other type of laser printer. Therefore, when purchasing a new laser printer for replacing the type of laser printer 2, a user only needs to exchange the lower casing 29 and does not need to exchange an upper casing 28. Accordingly, in this case, the user can purchase the paper sheet discharge apparatus 1A at a much lower cost than if the user was to purchase a whole paper sheet discharge apparatus 1A for replacing. Further, a redesigning of the paper sheet discharge apparatus 1 including the upper casing 28 is not necessary for each type of laser printer. Therefore, time and trouble for research and development of the paper sheet discharge apparatuses 1 and 1A will be reduced. Also, cost of manufacturing the paper sheet discharge apparatuses 1 and 1A can be reduced because of an increase of common parts of paper sheet discharge apparatuses 1 and 1A.

Figure 18:
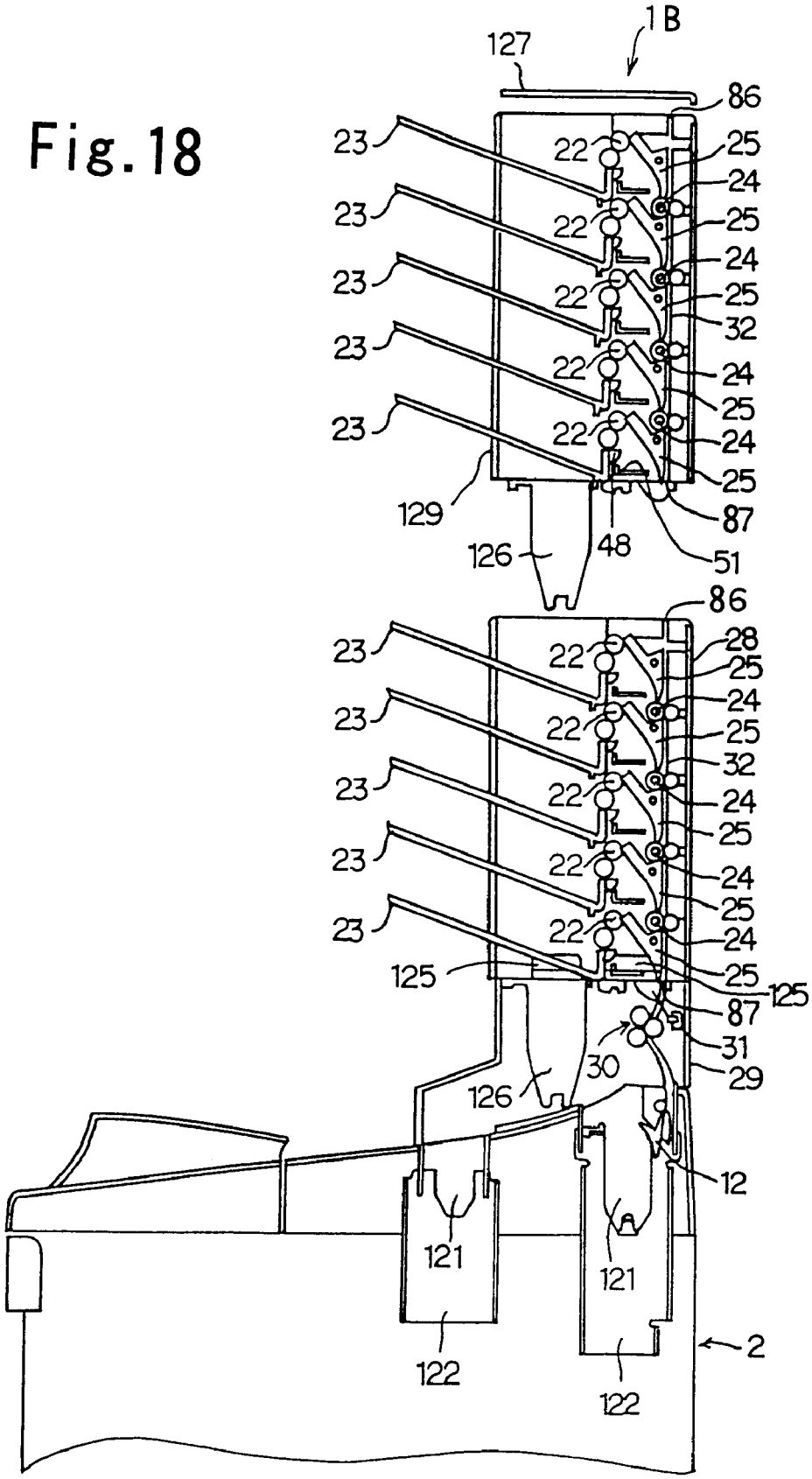
FIG. 18 is a side view of main components which shows an upper end of the upper casing detachably attached to an upper lid.

In the paper sheet discharge apparatus 1, as shown in FIG. 18, a discharge opening 86 of the upper casing 28 is constructed to be connectable to an inserting opening 87 of the other upper casing 129 when the other upper casing 129 is disposed on the upper most end of the upper casing 28.

As shown in FIG. 17, the upper most end of the upper casing 28 is detachably attached to an upper lid 127. On the other hand, as shown in FIG. 18, the upper lid 127 is removed from the upper most end of the upper casing 28 and the removed upper lid 127 is to be attached to the upper most end of the upper casing 129.

Figure 19:
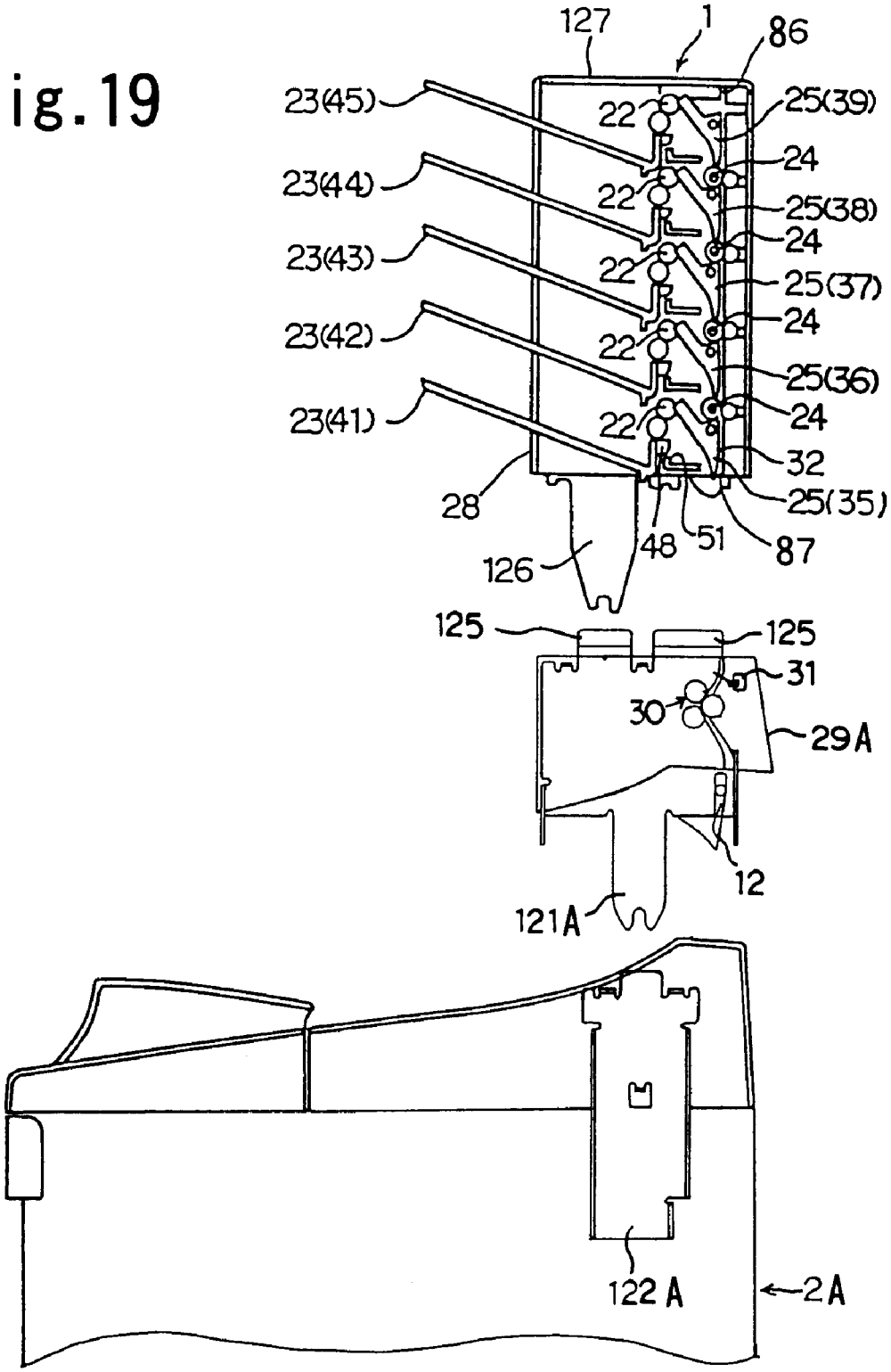
FIG. 19 is a side view of main components which shows an upper casing attached to an upper end of another upper casing.

The lower portion of the upper casing 129 is formed with the multiple third attaching plates 126 which protrude below the upper casing 129. Therefore, as shown in FIG. 19, the upper casing 129 can be disposed and positioned on the upper most end of the upper casing 28 by inserting each third attaching plate 126 of the upper casing 129 into an interior of the upper portion of the upper casing 28.

In the paper sheet discharge apparatus 1B, a discharge opening 86 of the upper casing 28 is constructed to be connectable to an inserting opening 87 of the other upper casing 129 when the other upper casing 129 is disposed on the upper most end of the upper casing 28. The upper lid 127 is attached to the upper most end of the upper casing 129 in the above described disposition. In this disposition, for example, the paper sheet can be advanced from the discharging opening 86 of the upper casing 28 into the inserting opening 87 of the upper casing 129 by switching all of the switching flappers 25 of the upper casing 28 to the vertically directed guide position. Accordingly, sorting and stacking of the paper sheet can be performed by connecting upper casings 28 and 129.

In case that only one upper casing 28 is used, the fifth flapper 39 corresponding to the fifth bin 45, which is the switching flapper 25 formed closest to the discharge opening 86, does not have to be swingably supported as the other switching flappers 25 are swingably supported, and instead can be fixed to the delivery-directed guide position. In the present embodiment, however, the fifth flapper 39 is swingably supported between the vertically directed guide position and the delivery-directed guide position, as the other switching flappers 25 are swingably supported, so that the paper sheet can be discharged to the discharge opening 86 and therefore, connecting of multiple upper casings 28 and 129 becomes available.

Therefore, the user can connect an appropriate number of additional upper casings based on the number of bins 23 that the user needs to add to the upper casing 28. Accordingly, the paper sheet discharge apparatus which has an appropriate number of bins 23, which number being best for sorting in accordance with a user's preference, is provided without designing the number of bins 23 which is necessary for the user. Further, even in a condition that the upper casings 28 and 129 are connected, the paper sheet can be discharged to each bin 23 without reducing discharging speed, since the transport rollers 24 and the delivery rollers 22 are provided in each upper casings 28 and 129.

The inserting openings 87 and the discharging openings 86 are disposed on the both ends of the vertically directed transport passage 33 since the inserting openings 87 are formed in the lower portion of the upper casings 28 and 129 and the discharging openings 86 are formed in the upper portion of the upper casings 28 and 129. Therefore, the effective transport passage can be formed in the upper casings 28 and 129 and further, the upper casings 28 and 129 can be disposed in an orderly manner in their vertical direction when they are connected.

Further, since multiple upper casings are piled up in vertical direction when they are connected for use, the area necessary for installing the connected upper casings is not increased as compared to an area necessary for a single upper casing 28. Therefore, the paper sheet discharge apparatus that has a large number of bins can be installed even in a small area.

Since the motors 65 are provided as a driving source in each upper casing 28 and 129, a transmission mechanism of a driving source is not necessary, even if each upper casing 28 and 129 is connected. Accordingly, construction of the paper sheet discharge apparatus can be simple.

Alternatively, it is available that the motors 65 are provided on only one of the upper casings 28 and 129, and a driving mechanism of each upper casing 28 and 129 is driven by way of gear connections between each upper casing 28 and 129. As a result of this construction, the number of motors 65 can be reduced.

Further, it is also available that the motors 65 is provided only in the lower casing 29 and are not provided in upper casings 28 and 129. As a result of this construction, not only the number of motors 65 can be reduced, but also construction of all upper casings 28 and 129 can be made in a common design.

What is claimed is:

1. A recording medium discharge system which is detachably attachable to a plurality of image forming apparatuses, comprising:

a plurality of recording medium receiving devices, each of the plurality of recording medium receiving devices including:

a plurality of installing units that install each of said plurality of recording medium receiving devices in each of the plurality of image forming apparatuses; and an introducing unit that introduces a recording medium where an image is formed by each of said plurality of image forming apparatuses, wherein each of said plurality of recording medium receiving devices includes one of said plurality of installing units which is structurally different from another of the plurality of installing units such that respective installing units correspond to each of said plurality of image forming apparatuses in which each of said plurality of recording medium receiving devices is installed by the respective installing units, and a recording medium sorting device, including:

a plurality of storing units that store the recording medium introduced by said introducing unit;

a discharge unit that discharges the recording medium introduced by said introducing unit into said plurality of storing units;

a transport unit that transports the recording medium introduced by said introducing unit to said discharge unit; and a switching unit that switches a transport direction of transporting the recording medium introduced by said introducing unit to the discharge unit and one of the plurality of storing units;

wherein said plurality of recording medium receiving devices and said recording medium sorting device are separately formed and detachably connectable to each other regardless of the structure of each of said plurality of installing units.

2. The recording medium discharge system according to claim 1, said plurality of recording medium receiving devices further including a curling eliminating unit that eliminates curling of the recording medium introduced by said introducing unit.

3. The recording medium discharge system according to claim 1, said transport unit including a transport passage that communicates with said introducing unit and that guides the recording medium introduced by said introducing unit in a substantially straight direction to said switching unit.

4. The recording medium discharge system according to claim 3, said introducing unit further including an introducing passage that guides the recording medium from a position downstream of said curling eliminating unit in a substantially straight direction to said transport passage of said recording medium sorting device.

5. The recording medium discharge system according to claim 1, said introducing unit further including a introducing passage that guides the recording medium from a position downstream of said curling eliminating unit in a substantially straight direction to said transport unit of said recording medium sorting device.

6. The recording medium discharge system according to claim 1, said introducing unit further including a switching member that switches a guiding direction between a first direction toward said recording medium sorting device, and a second direction toward each discharge unit of said plurality of image forming apparatuses.

* * * * *